US010752868B2

(12) United States Patent
Ulibarri et al.

(10) Patent No.: US 10,752,868 B2
(45) Date of Patent: Aug. 25, 2020

(54) UNIT DOSE DETERGENT COMPOSITION

(71) Applicant: Henkel IP & Holding GmbH, Duesseldorf (DE)

(72) Inventors: Montes Jose Ulibarri, West Jordan, UT (US); Kadar Gedi, Salt Lake City, UT (US); Ebner J. Manuel, Salt Lake City, UT (US); Maxime Pelletier, Sandy Hook, CT (US); Janet Coope-Epstein, Trumbull, CT (US)

(73) Assignee: Henkel IP & Holding GmbH (DE)

( * ) Notice: Subject to any disclaimer, the term of this patent is extended or adjusted under 35 U.S.C. 154(b) by 0 days.

(21) Appl. No.: 15/794,193

(22) Filed: Oct. 26, 2017

(65) Prior Publication Data

US 2018/0127692 A1 May 10, 2018

Related U.S. Application Data

(60) Provisional application No. 62/419,708, filed on Nov. 9, 2016.

(51) Int. Cl.

| | |
|---|---|
| ***C11D 17/04*** | (2006.01) |
| ***C11D 1/72*** | (2006.01) |
| ***C11D 3/20*** | (2006.01) |
| ***C11D 3/43*** | (2006.01) |
| ***C11D 10/04*** | (2006.01) |

(52) U.S. Cl.

CPC ..... *C11D 17/044* (2013.01); *C11D 1/72* (2013.01); *C11D 3/2068* (2013.01); *C11D 3/2079* (2013.01); *C11D 3/43* (2013.01); *C11D 10/045* (2013.01); *C11D 17/043* (2013.01)

(58) Field of Classification Search

None

See application file for complete search history.

(56) References Cited

U.S. PATENT DOCUMENTS

| | | | |
|---|---|---|---|
| 3,218,776 | A | 11/1965 | Cloud |
| 3,308,067 | A | 3/1967 | Diehl |
| 3,453,779 | A | 7/1969 | Reifenberg |
| 3,929,678 | A | 12/1975 | Laughlin et al. |
| 3,959,230 | A | 5/1976 | Hays |
| 3,976,586 | A | 8/1976 | Chakrabarti |
| 4,663,071 | A | 5/1987 | Bush et al. |
| 4,702,857 | A | 10/1987 | Gosselink |
| 4,721,580 | A | 1/1988 | Gosselink |
| 4,746,456 | A | 5/1988 | Kud et al. |
| 4,776,455 | A | 10/1988 | Anderson et al. |
| 4,877,896 | A | 10/1989 | Maldonado et al. |
| 4,968,451 | A | 11/1990 | Scheibel et al. |
| 5,616,781 | A | 4/1997 | Sajic et al. |
| 5,699,653 | A | 12/1997 | Hartman et al. |
| 5,722,217 | A | 3/1998 | Cloud |
| 5,945,394 | A | 8/1999 | Sajic et al. |
| 5,958,864 | A | 9/1999 | Artiga Gonzalez et al. |
| 5,968,893 | A | 10/1999 | Manohar et al. |
| 5,972,870 | A | 10/1999 | Anderson |
| 6,024,943 | A | 2/2000 | Ness et al. |
| 6,034,257 | A | 3/2000 | Oftring et al. |
| 6,037,319 | A | 3/2000 | Dickler et al. |
| 6,046,149 | A | 4/2000 | Sorrie et al. |
| 6,056,949 | A | 5/2000 | Menzi et al. |
| 6,071,871 | A | 6/2000 | Gosselink et al. |
| 6,194,375 | B1 | 2/2001 | Ness et al. |
| 6,242,403 | B1 | 6/2001 | Lammers et al. |
| 6,251,843 | B1 | 6/2001 | Chambers et al. |
| 6,340,661 | B1 | 1/2002 | Van Deurzen et al. |
| 6,458,754 | B1 | 10/2002 | Velazquez et al. |
| 6,727,215 | B2 | 4/2004 | Roberts et al. |
| 6,794,347 | B2 | 9/2004 | Hsu et al. |
| 6,878,679 | B2 | 4/2005 | Sommerville-Roberts et al. |
| 6,964,943 | B1 | 11/2005 | Bettiol et al. |
| 7,141,077 | B2 | 11/2006 | Detering et al. |
| 7,259,134 | B2 | 8/2007 | Beckholt et al. |
| 7,282,472 | B2 | 10/2007 | Kapur et al. |
| 7,304,025 | B2 | 12/2007 | Hardy et al. |
| 7,329,441 | B2 | 2/2008 | Catlin et al. |
| 7,439,215 | B2 | 10/2008 | Catlin et al. |
| 7,464,519 | B2 | 12/2008 | Fisher et al. |
| 7,595,290 | B2 | 9/2009 | Pounds et al. |
| 7,776,807 | B2 | 8/2010 | Canto et al. |
| 8,426,353 | B2 | 4/2013 | Ouali et al. |
| 8,551,929 | B2 | 10/2013 | Graham et al. |
| 8,883,703 | B2 | 11/2014 | Stenger et al. |
| 2008/0108541 | A1 | 5/2008 | Swazey |
| 2008/0146485 | A1 | 6/2008 | Swazey |
| 2010/0113318 | A1* | 5/2010 | Wiedemann ..... C11D 17/043 510/218 |
| 2011/0224127 | A1 | 9/2011 | Blyth et al. |
| 2012/0122747 | A1 | 5/2012 | Nekmard et al. |
| 2012/0129748 | A1* | 5/2012 | Gordon ..... C11D 17/042 510/224 |
| 2017/0218314 | A1* | 8/2017 | Roy ..... C11D 17/0095 |

FOREIGN PATENT DOCUMENTS

| | | | |
|---|---|---|---|
| WO | 0208380 | A1 | 1/2002 |
| WO | WO 2012/104611 | A1 * | 8/2012 |
| WO | 2013160023 | A1 | 10/2013 |
| WO | 2014017913 | A1 | 1/2014 |
| WO | 2014142651 | A1 | 9/2014 |

OTHER PUBLICATIONS

International Search Report PCT/US2017/060743 Completed: Feb. 13, 2018; dated Feb. 13, 2018 15 pages.

* cited by examiner

*Primary Examiner* — Lorna M Douyon

(74) *Attorney, Agent, or Firm* — Bojuan Deng

(57) ABSTRACT

The present disclosure provides a single-compartment, multiple phase unit dose dishwashing detergent composition and a single-compartment, multiple phase unit dose fabric cleaning or treatment composition, the preparations and uses thereof.

20 Claims, 2 Drawing Sheets

UNIT DOSE DETERGENT COMPOSITION

FIELD OF INVENTION

This invention is in the fields of household and industrial cleaning. More particularly, the invention relates to a single-compartment, multiple phase unit dose detergent compositions, preparation and use thereof.

BACKGROUND OF THE INVENTION

Unit dose detergent products are often found by consumers to be preferable for use in automatic dishwashing and automatic fabric-laundering applications. Such unit dose products have several advantages, including convenience of use and dispensing, lower cost per use, and avoiding or minimizing direct skin contact with potentially irritating cleaning compositions.

U.S. Pat. No. 7,439,215 discloses unit dose automatic dishwashing compositions enclosed within a multi-chambered water-soluble polymeric film pouch, with one composition (e.g., a powdered detergent composition) contained in one compartment, and a second composition (e.g., a liquid rinse aid) contained in a second compartment separate from (and sealed off from) the first compartment. Other unit-dose cleaning systems contained in multi-compartment water-soluble pouches for use in dishwashing are disclosed, for example, in U.S. Pat. Nos. 3,218,776; 4,776,455; 6,727,215; 6,878,679; 7,259,134; 7,282,472; 7,304,025; 7,329,441; 7,439,215; 7,464,519; and 7,595,290.

U.S. Pat. No. 5,972,870 discloses a unit dose multi-layered laundry tablet which may include a detergent in the outer layer and a fabric softener, or water softener or fragrance, in the inner layer. Other unit dose laundry detergent products involve dual compartments as disclosed in WO 02/08380 where the first compartment contains a detergent composition and the second compartment contains a fabric softening composition.

The use of multi-compartment systems, such as those described above, however, has several disadvantages, for example, the need to produce multiple compartment pouches in which each compartment must be sealed from the others during manufacturing increases the costs and difficulty of manufacturing unit dose products, which often in turn increases the cost of the product to consumers. It is advantageous to produce a single-compartment unit dose detergent composition that has optimum performance, is economically produced, and is aesthetically pleasing to consumers.

U.S. Pat. No. 8,551,929 discloses a single-compartment unit dose detergent composition where a polyvinylalcohol (PVOH) pouch encloses a solid gel formulation of high viscosity at room temperature, which can be layered directly on top of a powder detergent formulation.

There is still a need for single-compartment unit dose detergent compositions. Particularly, there is a need for single-compartment unit dose automatic dishwashing compositions, which can provide required detergency performance, as well as reduced spotting and filming on washed dishware. The present disclosure provides such a composition, as well as a method of producing and using such a composition.

BRIEF SUMMARY OF THE INVENTION

In various embodiments, the present disclosure provides a unit dose dishwashing detergent composition comprising:

(i) a water-soluble single-compartment container defining a single compartment; (ii) a solid cleaning composition comprising at least one detersive surfactant; and (iii) a solid gel composition comprising (a) a non-ionic surfactant in an amount from about 2.5 wt % to 50 wt %; (b) a polar organic solvent in an amount up to about 70 wt %; (c) water; and (d) a water soluble structuring agent in an amount from 0.5 wt % to about 15 wt %, or a water soluble co-structuring agent in an amount from 0.5 wt % to about 65 wt %, or a combination thereof, based on the total weight of the solid gel composition. The solid cleaning composition and the solid gel composition are contained in the single compartment, and the solid cleaning composition is in direct contact with the solid gel composition. There is little or no visible intermixing occurring at the interphase between the solid cleaning composition and the solid gel composition. The single-compartment container may be a formed, sealed pouch. In some embodiments, the weight ratio of the solid cleaning composition to the solid gel composition ranges from about 10:1 to 1:1. The unit dose is formulated for removing soils from soiled dishware in an automatic dishwashing machine, and provides a reduced spotting and filming on the washed dishware.

In some embodiments, the solid cleaning composition can be in the form of powders, particles, granules, pastilles, prills, tablets, crystals, or a combination thereof.

The detersive surfactant in the solid cleaning composition includes an anionic surfactant, a non-ionic surfactant, a zwitterionic surfactant (ampholytic surfactant), a cationic surfactant, or a combination thereof.

In some embodiments, the solid gel composition contains a structuring agent comprising a $C_{12}$-$C_{22}$ fatty acid salt, or a mixture of $C_{12}$-$C_{22}$ fatty acid salts, for example, sodium stearate, sodium palmitate, sodium arachidate, sodium behenate, or a mixture of thereof. In some embodiments, the amount of the structuring agent can range from about 1 wt % to about 10 wt % calculated based on the total weight of the solid gel composition.

In some embodiments, the solid gel composition contains a co-structuring agent comprising polyethylene glycol, a polyethylene-polypropylene block copolymer, polyvinyl alcohol, polyvinyl pyrollidone, a natural or semi-synthetic polymer, or a mixture thereof, wherein the natural or semi-synthetic polymer includes gellan gum, gelatin, casein, collagen, egg whites, guar gum, acia, tragacanth, bean gum, pectin, starch, xanthan gum, dextran, magnesium aluminum silicante (Veegum), methylcellulose, ethylcellulose, hydroxyethyl cellulose, hydroxypropyl cellulose, hydroxypropyl methylcellulose, carboxymethyl cellulose, or a mixture thereof. In some embodiments, the co-structuring agent is present in an amount from about 5 wt % to about 60 wt % calculated based on the total weight of the solid gel composition.

In some embodiments, the solid gel composition contains a non-ionic surfactant comprising alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof. In some embodiments, the non-ionic surfactant is an alkoxylated alcohol. In some embodiments, the non-ionic surfactant is present in an amount between about 2.5 and about 49 wt % calculated based on the total weight of the solid gel composition.

In some embodiments, the solid gel composition contains a polar organic solvent, including a monohydric or polyhydric alcohol, a glycol, an alkylene glycol, a dialkylene glycol, a trialkylene glycol, a polyethylene glycol, or a mixture thereof. In some embodiments, the polar organic solvent may be ethylene glycol, propylene glycol, dipropylene glycol, butylene glycol, hexylene glycol, glycerin, tripropylene glycol, trimethylene glycol, diethylene glycol, sorbitol, ethanol, propanol, isopropanol, butanediol, a polyethylene glycol having a molecular weight ranging from about 200 to about 600, or a mixture thereof. In some embodiments, the polar organic solvent comprises propylene glycol, dipropylene glycol, or a mixture thereof. In some embodiments, the polar organic solvent is present in an amount between about 10 wt % and about 70 wt % calculated based on the total weight of the solid gel composition.

In some embodiments, the solid gel composition contains water in an amount of greater than about 3 wt %, or between about 3 wt % and about 40 wt % calculated based on the total weight of the solid gel composition.

In some embodiments, the solid gel composition may further comprise a colorant, an enzyme, a fragrance, a corrosion inhibitor, a chlorine scavenger, a water softener, a rinse aid, a bittering agent, an anti-slip agent, or a combination thereof.

The solid gel composition of the present disclosure has one or more of the following characteristics: (1) the solid gel has a hardness between about 10 N and about 500 N, when measured on a circular solid gel sample with dimensions of 1 inch diameter×0.5 inch thickness, or 1 inch diameter×0.15 inch thickness, using a force analyzer; (2) the solid gel has a solidification temperature between about 35° C. and about 70° C., when measured by DSC at a cooling rate of 10° C./min, and (3) the solid gel has a melting temperature between about 50° C. and about 85° C., when measured by DSC at a heating rate of 10° C./min.

In various embodiments, the present disclosure provides a unit dose fabric cleaning or treating composition comprising: (i) a water-soluble single-compartment container defining a single compartment; (ii) a solid cleaning or booster composition comprising one or more components selected from the group consisting of a detersive surfactant, a clay, a salt, an enzyme, a chelating agent, a bleach, a bleach activator, a bleach catalyst, a silicone, a soil release polymer, an anti-redeposition polymer, a fragrance, an encapsulated fragrance, a cooling agent, a colorant, a shading dye, an optical brightener, a whitening agent, a fabric softener, and a combination thereof; and (iii) a solid gel composition comprising: (a) water, or a polar organic solvent, or a combination thereof; and (b) a water soluble structuring agent, or a water soluble co-structuring agent, or a combination thereof. The solid cleaning or booster composition and the solid gel composition are contained in the single compartment, and the solid cleaning or booster composition is in direct contact with the solid gel composition. The single-compartment container may be a formed, sealed pouch.

The solid gel composition of the present disclosure has one or more of the following characteristics: (1) the solid gel has a hardness between about 10 N and about 500 N, when measured on a circular solid gel sample with dimensions of 1 inch diameter×0.5 inch thickness, or 1 inch diameter×0.15 inch thickness, using a force analyzer; (2) the solid gel has a solidification temperature between about 35° C. and about 70° C., when measured by DSC at a cooling rate of 10° C./min, and (3) the solid gel has a melting temperature between about 50° C. and about 85° C., when measured by DSC at a heating rate of 10° C./min.

In some embodiments, the weight ratio of the solid cleaning or booster composition to the solid gel composition ranges from about 10:1 to 1:1. The unit dose composition is formulated suitable for cleaning fabric, or providing fabric care benefits or sensorial benefits (such as a fragrance booster, an in-wash softening, malodor control, whitening, color protection) to fabric in an automatic fabric-laundering machine.

In some embodiments, the solid gel may further contain an anionic surfactant, a cationic surfactant, a zwitterionic surfactant, a non-ionic surfactant, a fragrance, an encapsulated fragrance, a silicone, an anti-redeposition polymer, a grease or soil release polymer (such as polyethyleneimine polymer, modified polyethyleneimine polymer, and more), an enzyme, a malodor control agent (such as zinc ricinoleate), a dye (such as a shading dye, a fluorescent whitening dye), a dye transfer inhibitor, or a combination thereof.

In some embodiments, the structuring agent comprises a $C_{12}$-$C_{22}$ fatty acid salt, or a mixture of $C_{12}$-$C_{22}$ fatty acid salts, for example, sodium stearate, sodium palmitate, sodium arachidate, sodium behenate, or a mixture of thereof. In some embodiments, the amount of the structuring agent can range from about 0.5 wt % to about 15 wt % calculated based on the total weight of the solid gel composition.

In some embodiments, the co-structuring agent comprises polyethylene glycol, a polyethylene-polypropylene block copolymer, polyvinyl alcohol, polyvinyl pyrollidone, a natural or semi-synthetic polymer, or a mixture thereof, wherein the natural or semi-synthetic polymer includes gellan gum, gelatin, casein, collagen, egg whites, guar gum, acia, tragacanth, bean gum, pectin, starch, xanthan gum, dextran, magnesium aluminum silicante (Veegum), methylcellulose, ethylcellulose, hydroxyethyl cellulose, hydroxypropyl cellulose, hydroxypropyl methylcellulose, carboxymethyl cellulose, or a mixture thereof. In some embodiments, the co-structuring agent is present in an amount from about 0.5 wt % to about 95 wt % calculated based on the total weight of the solid gel composition.

In some embodiments, the solid gel composition contains a polar organic solvent, including a monohydric or polyhydric alcohol, a glycol, an alkylene glycol, a dialkylene glycol, a trialkylene glycol, a polyethylene glycol, or a mixture thereof. In some embodiments, the polar organic solvent comprise ethylene glycol, propylene glycol, dipropylene glycol, butylene glycol, hexylene glycol, glycerin, tripropylene glycol, trimethylene glycol, diethylene glycol, sorbitol, ethanol, propanol, isopropanol, butanediol, a polyethylene glycol having a molecular weight ranging from about 200 to about 600, or a mixture thereof. In some embodiments, the polar organic solvent comprises propylene glycol, dipropylene glycol, or a mixture thereof. In some embodiments, the polar organic solvent is present in an amount between about 2 wt % and about 65 wt % calculated based on the total weight of the solid gel composition.

In some embodiments, the solid gel composition contains water in an amount of about 3 wt % and about 30 wt % calculated based on the total weight of the solid gel composition.

In some embodiments, the unit dose fabric cleaning or treating composition may further contain other beneficial agents, such as a biocidal agent, a foam stabilizing agent, a corrosion inhibitor, a water softener, a chlorine scavenger, an anti-oxidant, an anti-slip agent, a pH adjusting agent, a UV absorber, a bitter agent, or a combination thereof.

DETAILED DESCRIPTION OF THE INVENTION

Figure 1:
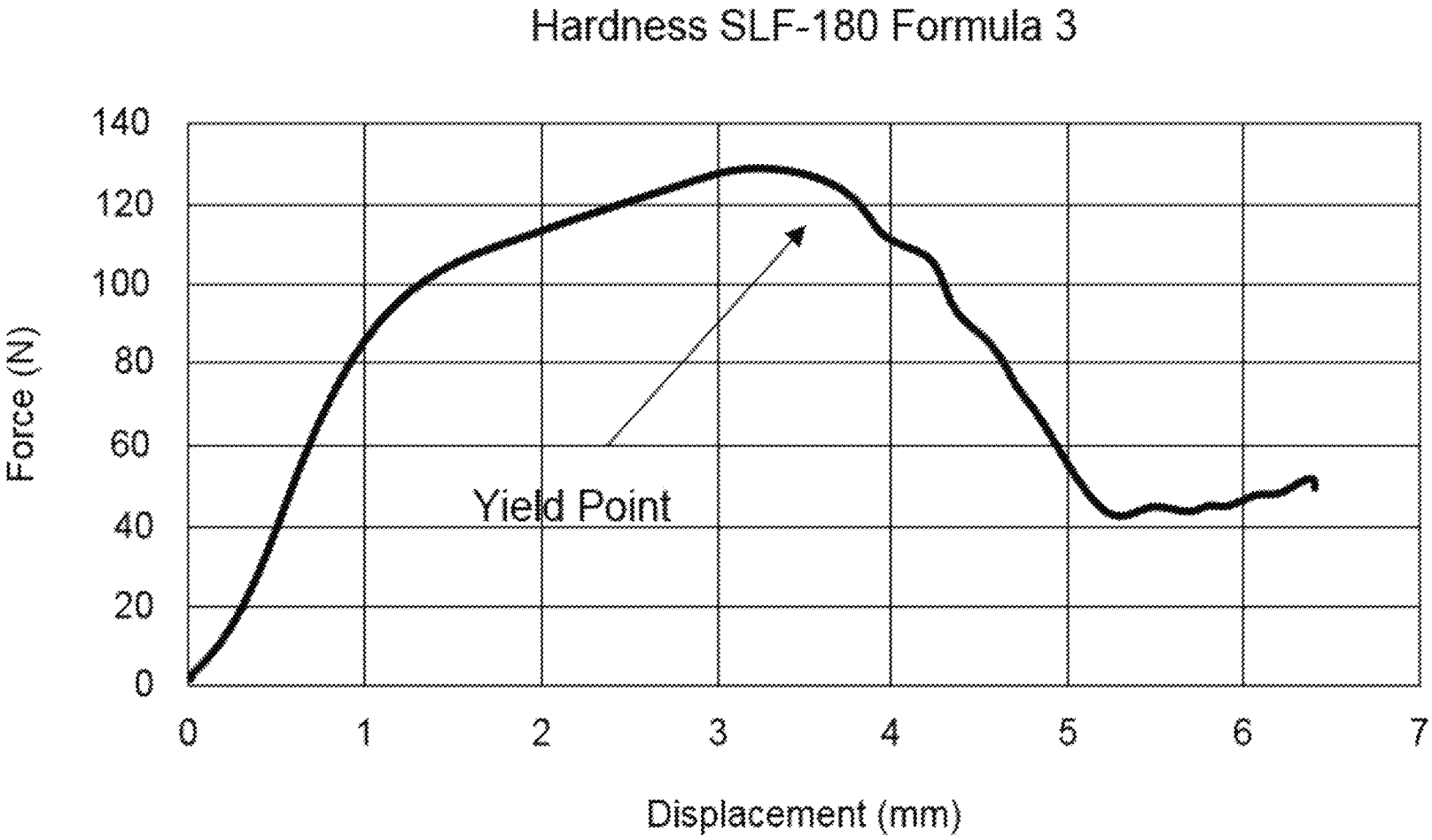
FIG. 1 is a graph obtained from gel hardness measurement of the solid gel Formula 3 (described in Table 1 below) using a force analyzer.
Figure 2B:
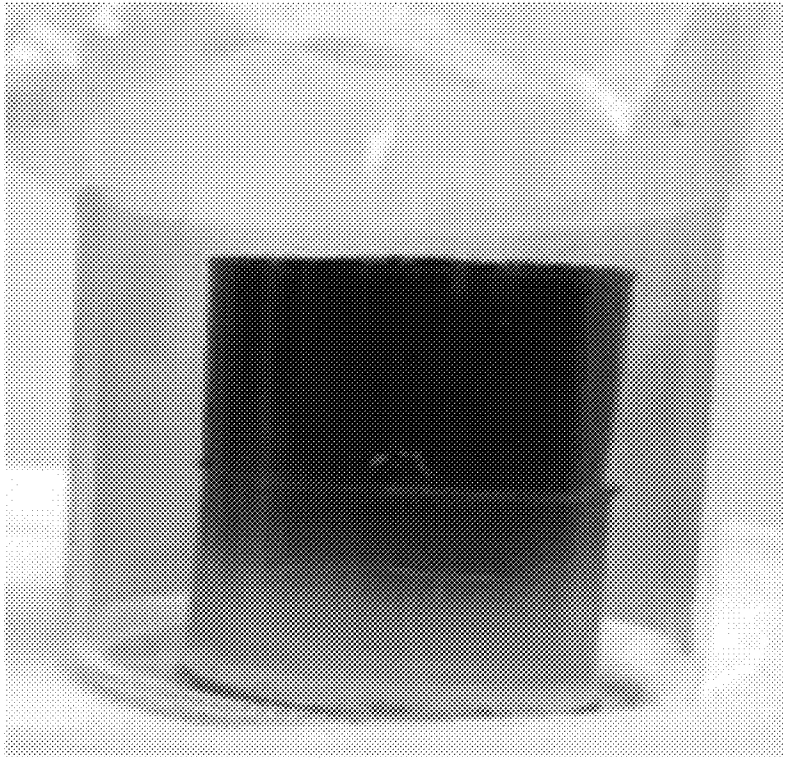
FIGS. 2A and 2B illustrate the degree of migration of two solid gels in a single container.
Figure 2A:
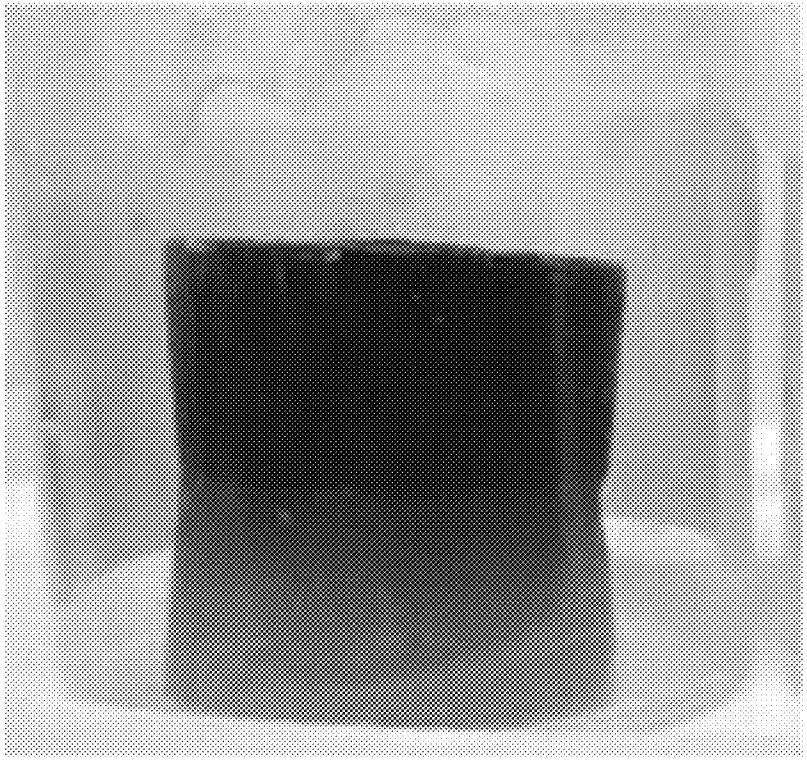

The following description provides specific details, such as materials and dimensions, to provide a thorough understanding of the present invention. The skilled artisan, however, will appreciate that the present invention can be practiced without employing these specific details. Indeed, the present invention can be practiced in conjunction with processing, manufacturing or fabricating techniques conventionally used in the detergent industry. Moreover, the processes below describe only steps, rather than a complete process flow, for manufacturing the compositions and detergents containing the compositions according to the present invention.

As used herein, "a," "an," or "the" means one or more unless otherwise specified.

Open terms such as "include," "including," "contain," "containing" and the like mean "comprising."

The term "about" as used herein, includes the recited number ±10%.

The "wt %" refers to the weight percent.

The term "or" can be conjunctive or disjunctive.

The term "aerating" denotes entrapping or incorporating air or gaseous material into a composition by any suitable means. Air or gaseous material is "entrapped" or "incorporated" into a composition by adding air or gaseous material to the composition while the composition is in a liquid, melted, or molten form.

I. Unit Dose Dishwashing Detergent Composition

In one aspect, the present disclosure provides a unit dose dishwashing detergent composition comprising: (i) a water-soluble single-compartment container defining a single compartment; (ii) a solid cleaning composition comprising at least one detersive surfactant; and (iii) a solid gel composition. The solid cleaning composition and the solid gel composition are contained in the single compartment, and the solid cleaning composition is in direct contact with the solid gel composition. Preferably, there is little or no visible intermixing occurring at the interphase between the solid cleaning composition and the solid gel composition.

Water-Soluble Single-Compartment Container

The unit dose dishwashing detergent composition of the present disclosure is enclosed in a water-soluble single-compartment container defining a single compartment. The water-soluble single-compartment container used here is made from a water-soluble material which dissolves, ruptures, disperses, or disintegrates upon contact with water, releasing the composition contained therein. The water soluble single-compartment container may be formed from a water soluble polymer. Non-limiting examples of suitable water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, and mixtures thereof.

In some embodiments, the water-soluble single-compartment container is made from a lower molecular weight water-soluble polyvinyl alcohol (PVOH) film-forming resin. Suitable PVOH resins are sold under trade name MONOSOL® (available from MonoSol LLC, Merrillville, Ind.) and SOLUBLON® (available from Aicello, Toyohashi, Aichi, Japan).

In some embodiments, the water-soluble single-compartment container may further contain a cross-linking agent, e.g., a cross-linking agent selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane, n-diazopyruvates, phenylboronic acids, cis-platin, divinylbenzene, polyamides, dialdehydes, triallyl cyanurates, N-(2-ethanesulfonylethyl) pyridinium halides, tetraalkyltitanates, titanates, borates, zireonates, and mixtures thereof. In one embodiment, the cross-linking agent is boric acid or sodium borate.

In some embodiments, the water-soluble single-compartment container can have a protective layer between the film polymer and the composition contained therein. In one embodiment, the protective layer may comprise polytetrafluoroethylene (PTFE).

The water soluble single-compartment container may be in any suitable/desirable forms, for example, in the form of a pouch.

Solid Cleaning Composition

Detersive Surfactant

The unit dose dishwashing detergent composition of the present disclosure comprises a solid cleaning composition comprising at least one detersive surfactant. All detersive surfactants known in the art suitable for dishwashing application can be used for the solid cleaning composition. The detersive surfactants include, but are not limited to an anionic surfactant, a nonionic surfactant, a cationic surfactant, a zwitterionic surfactant (amphoteric surfactant), or mixtures thereof.

In some embodiments, the detersive surfactant comprises a non-ionic surfactant, which may be or may not be the same non-ionic surfactant used in the solid gel composition as described below. In some embodiments, the non-ionic surfactant comprises an alkoxylated alcohol.

In some embodiments, the solid cleaning composition comprises at least one non-ionic surfactant in an amount ranging from about 0.5 wt % to about 20 wt %, from about 1 wt % to about 15 wt %, from about 1 wt % to about 10 wt %, or from about 1 wt % to about 5 wt % calculated based on the total weight of the solid cleaning composition.

Other Ingredients

The solid cleaning composition may further contain one or more other ingredients for assisting or enhancing cleaning performance, or for modify the aesthetics of the composition, etc. The ingredients include those commonly/routinely included in a dishwashing detergent composition, for example, a builder, a colorant, an enzyme, a fragrance, an encapsulated fragrance, a biocidal agent, a chelating agent, a foam stabilizing agent, a grease or soil release polymer, an anti-redeposition agent, an anti-slip agent, a pH adjusting agent, a UV absorber, a corrosion inhibitor, a water softening agent, a malodor control agent, or a combination thereof. The following are illustrative examples of such ingredients.

Suitable builders include organic or inorganic detergency builders. Examples of water-soluble inorganic builders that can be used, either alone or in combination with themselves or with organic alkaline sequestrant builder salts, are glycine, alkyl and alkenyl succinates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate, sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071. Other preferred builders include the sodium salt of methyl glycine diacetic acid (Trilon® M from BASF), L-glutamic acid N,N-diacetic acid, tetrasodium salt (e.g., Dissolvine® GL (GLDA) from Akzo Nobel), and the sodium salt of iminodisuccinic acid.

Fragrance (perfume) refers to and includes any fragrant substance or mixture of substances including natural (obtained by extraction of flowers, herbs, leaves, roots, barks, wood, blossoms or plants), artificial (mixture of natural oils or oil constituents) and synthetically produced odoriferous substances. The fragrance can comprise an ester, an ether, an aldehyde, a ketone, an alcohol, a hydrocarbon, or a mixture thereof. The fragrance can have, for example, a musky scent, a putrid scent, a pungent scent, a camphoraceous scent, an ethereal scent, a floral scent, a peppermint scent, or combinations thereof.

Typically, fragrances are complex mixtures of blends of various organic compounds (such as alcohols, aldehydes, ethers, aromatic compounds) and varying amounts of (such as from 1% to 70% by weight) essential oils (e.g., terpenes), and the essential oils themselves being volatile odoriferous compounds and also serving to dissolve the other components of the fragrance. Suitable fragrance ingredients include those disclosed in "Perfume and Flavour Chemicals (Aroma Chemicals)," published by Steffen Arctander (1969), which is incorporated herein by reference. Suitable fragrance can also be a pro-fragrance, such as thiodamascone (available from Firmenich), which releases the fragrance damascene upon oxidation.

Fragrances may comprise methyl formate, methyl acetate, methyl butyrate, ethyl butyrate, isoamyl acetate, pentyl butyrate, pentyl pentanoate, octyl acetate, myrcene, geraniol, nerol, citral, citronellol, linalool, nerolidol, limonene, camphor, terpineol, alpha-ionone, thujone, benzaldehyde, eugenol, cinnamaldehyde, ethyl maltol, vanillin, anisole, anethole, estragole, thymol, indole, pyridine, furaneol, 1-hexanol, cis-3-hexenal, furfural, hexyl cinnamaldehyde, fructone, hexyl acetate, ethyl methyl phenyl glycidate, dihydrojasmone, oct-1-en-3-one, 2-acetyl-1-pyrroline, 6-acetyl-2,3,4,5-tetrahydropyridine, gamma-decalactone, gamma-nonalactone, delta-octalone, jasmine lactone, massoia lactone, wine lactone, sotolon, grapefruit mercaptan, methanthiol, methyl phosphine, dimethyl phosphine, nerolin, 2,4,6-trichloroanisole, or combinations thereof.

In some embodiments, the fragrance is High Five ACM 190991 F (Firmenich), Super Soft Pop 190870 (Firmenich), Mayflowers TD 485531 EB (Firmenich), or combinations thereof. Other known fragrances, or any fragrance commercially available from a fragrance supplier (e.g., Firmenich, Givaudan, etc.) may also suitably be used herein.

In some embodiments, the fragrance component is in the form of free fragrance (such as a fragrance oil). In other embodiments, at least some fragrance components can be encapsulated in, for example, water-insoluble shell, microcapsule, nanocapsule or combinations thereof. The microcapsules can be water-soluble or water-insoluble.

Examples of encapsulated fragrances are described in, for example, U.S. Pat. Nos. 6,024,943, 6,056,949, 6,194,375, 6,458,754 and 8,426,353, and US 2011/0224127 A1, each of which is incorporated by reference herein in its entirety. An exemplary encapsulated fragrance may contain a fragrance, a clay (e.g., a smectite-type clay selected from the group consisting of bentonite, pyrophylite, hectorite, saponite, sauconite, nontronite, talc and beidellite, Veegum® T magnesium aluminum silicate or Laponite® sodium lithium magnesium silicate), and a particulate cellulose material containing cellulose, pectin and hemicellulose.

When present, the encapsulated fragrance can be contained, for example, in an amount ranging from about 0.001 wt % to about 10 wt %, or from about 1 wt % to about 10 wt % calculated based on the weight of the solid cleaning composition.

Suitable enzymes include those known in the art, such as amylolytic, proteolytic, cellulolytic or lipolytic type, and those listed in U.S. Pat. No. 5,958,864. One suitable protease, sold under the trade name SAVINASE® by Novo Nordisk Industries A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novo Nordisk Industries A/S. Also suitable enzymes include blends of two or more of these enzymes, for example, a protease/lipase blend, a protease/amylase blend, a protease/amylase/lipase blend, and the like.

Suitable biocidal agents include an anti-microbial, a germicide, or a fungicide. For example, a biocidal agent may include triclosan (5-chloro-2-(2,4-dichloro-phenoxy) phenol)), and the like.

Suitable foam stabilizing agents include a polyalkoxylated alkanolamide, amide, amine oxide, betaine, sultaine, $C_8$-$C_{18}$ fatty alcohols, and those disclosed in U.S. Pat. No. 5,616,781. An auxiliary foam stabilizing surfactant, such as a fatty acid amide surfactant, may also be included in the composition. Suitable fatty acid amides include $C_8$-$C_{20}$ alkanol amides, monoethanolamides, diethanolamides, or isopropanolamides.

Any polymeric grease or soil release agent known to those skilled in the art can optionally be employed herein. Examples of grease or soil release polymers are described in, for example, U.S. Pat. Nos. 3,959,230, 4,702,857, 4,721,580, 4,746,456, 4,877,896, 4,968,451, 5,968,893, 6,071,871, 6,340,661, 6,964,943 and 7,141,077, and US 20120122747 A1, each of which is incorporated by reference herein in its entirety. Suitable grease or soil release polymers include those sold under the trade name SOKALAN®, such as SOKALAN® HP-20 and SOKALAN® HP-22 (available from BASF).

Suitable anti-redeposition agents are typically polycarboxylate materials that can be prepared by polymerizing or copolymerizing suitable unsaturated monomers (e.g., unsaturated monomeric acids). Suitable unsaturated monomeric acids include acrylic acid, maleic acid (or maleic anhydride), fumaric acid, itaconic acid, aconitic acid, mesaconic acid, citraconic acid and methylenemalonic acid. The presence in the polycarboxylates herein of monomeric segments, containing no carboxylate radicals such as vinylmethyl ether, styrene, ethylene, etc. is suitable provided that such segments do not constitute more than about 40 wt % of the polymer.

Particularly suitable polycarboxylates can be derived from acrylic acid. Such acrylic acid-based polymers which are useful herein are the water-soluble salts of polymerised acrylic acid. The average molecular weight of such polymers in the acid form ranges from about 2,000 to 10,000, from about 4,000 to 7,000, or from about 4,000 to 5,000. Water-soluble salts of such acrylic acid polymers can include, for example, the alkali metal, ammonium and substituted ammonium salts. Soluble polymers of this type are known materials (e.g., those described in U.S. Pat. No. 3,308,067). In one embodiment, the polycarboxylate is sodium polyacrylate.

Acrylic/maleic-based copolymers may also be used as a component of the anti-redeposition agent. Such materials include the water-soluble salts of copolymers of acrylic acid and maleic acid. The average molecular weight of such copolymers in the acid form ranges from about 2,000 to 100,000, from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Soluble acrylate/maleate copolymers are known materials (e.g., those described in EP 193360). Other useful polymers include maleic/acrylic/vinyl alcohol terpolymers (e.g., a terpolymer containing 45/43/10 of acrylic/maleic/vinyl alcohol as described in EP 193360).

Polyethylene glycol (PEG) can also act as a clay soil removal-anti-redeposition agent. Molecular weights of PEG can range from about 500 to about 100,000, about 1,000 to about 50,000, or about 3,000 to about 10,000. In addition, polyaspartate and polyglutamate dispersing agents may also be used as soil removal-anti-redeposition agent.

If present, the amount of anti-redeposition polymer may range from about 0.01 to about 10 wt %, from about 0.02 to about 8 wt %, or from about 0.03 to about 6 wt % calculated based on a total weight of the solid cleaning composition.

The solid cleaning composition may be provided in any suitable forms, such as powders, particles, granules, pastilles, prills, tablets, crystals, or a combination thereof. In some embodiments, the solid cleaning composition is the form of powders or particles.

Solid Gel Composition

The solid gel composition comprises: (a) a non-ionic surfactant in an amount from about 2.5 wt % to 50 wt %; (b) a polar organic solvent in an amount up to about 70 wt %; (c) water; and (d) a water soluble structuring agent in an amount from 0.5 wt % to about 15 wt %, or a water soluble co-structuring agent in an amount from 0.5 wt % to about 65 wt %, or a combination thereof.

Structuring Agents

The structuring agent of the present disclosure comprises a $C_{12}$-$C_{22}$ fatty acid salt, or a mixture of $C_{12}$-$C_{22}$ fatty acid salts. In preferred embodiments, the structure agent is water soluble.

Suitable water soluble structuring agent may be any suitable water-soluble salt of the corresponding fatty acid. In one embodiment, the fatty acid salt has Formula (I):

$$R—C(O)O^-X^+ \quad (I),$$

wherein R is a $C_5$-$C_{22}$ linear or branched aliphatic group, and $X^+$ is a metal ion. Preferably, R is a $C_{12}$-$C_{22}$ linear or branched aliphatic group, which may also be hydroxy-substituted.

In some embodiments, the fatty acid salt is hexanoic acid salt, heptanoic acid salt, octanoic acid salt, nonanoic acid salt, capric acid salt, undecanoic acid salt, lauric acid salt, tridecanoic acid salt, myristic acid salt, pentadecanoic acid salt, palmitic acid salt, heptadecanoic acid salt, octadecanoic (also called stearic) acid salt, nonadecanoic acid salt, eicosanoic acid salt, heneicosanoic acid salt, docosanoic acid salt, myristoleic acid salt, palmitoleic acid salt, sapienic acid salt, oleic acid salt, elaidic acid salt, vaccenic acid salt, linoleic acid salt, linoelaidic acid salt, arachidonic acid salt, eicosapentaenoic acid salt, erucic acid salt, docosahexaenoic acid salt, hydroxystearic acid or a mixture thereof.

In some embodiments, the fatty acid salt is a stearate. In some embodiments, the fatty acid salt comprises a mixture of a palmitate and a stearate. In some embodiments, the corresponding fatty acid is a mixture, such as coconut fatty acid.

In some embodiments, the fatty acid salt is in the form of an alkali metal salt, for example, lithium, sodium or potassium salt, or a mixture thereof. Preferably, the salt is a sodium salt.

In some embodiments, the structuring agent comprises sodium stearate, sodium palmitate, sodium arachidate, sodium behenate, or a mixture of thereof.

The amount of structuring agent in the solid gel composition is selected so as to have the desired gelling effect and hardness while minimizing the level of foaming. In some embodiments, the solid gel composition of present disclosure contains from about 0.5 wt % to about 15 wt %, from about 1 wt % to about 10 wt %, from about 2 wt % to about 8 wt %, from about 3 wt % to 7 wt %, from about 3 wt % to 6 wt %, from about 4 wt % to 6 wt %, from about 4 wt % to 5 wt %, or from about 1 wt %, about 2 wt %, or about 3 wt %, about 4 wt %, about 5 wt %, about 6 wt %, or about 7 wt % of fatty acid salt calculated based on the total weight of the solid gel composition. In some embodiments, the solid gel composition contains up to about 10 wt % of the fatty acid salt, more preferably up to about 9 wt %, up to about 8 wt %, up to about 7 wt %, up to about 6 wt %, up to about 5 wt %, up to about 4 wt %, up to about 3 wt %, or up to about 2 wt % of fatty acid salt calculated based on the total weight of the solid gel composition.

Co-Structuring Agents

The co-structuring agent of the present disclosure includes polymeric materials, which will swell or expand when hydrated. Suitable polymeric materials include, but are not limited to polyethylene glycol, polyethylene-polypropylene block copolymer, polyvinyl alcohol, polyvinyl pyrollidone, polyacrylate, natural or semi-synthetic polymers, or a mixture thereof. The natural or semi-synthetic polymers can be gellan gum, gelatin, casein, collagen, egg whites, guar gum, acia, tragacanth, bean gum, pectin, starch, xanthan gum, dextran, magnesium aluminum silicate (Veegum), methylcellulose, ethylcellulose, hydroxyethyl cellulose, hydroxypropyl cellulose, hydroxypropyl methylcellulose, carboxymethyl cellulose, or a mixture thereof. In preferred embodiments, the co-structuring agent is water soluble.

Suitable water soluble co-structuring agent includes polyethylene glycol (PEG) having a molecular weight ranging from about 1,000 to about 12,000, from about 3,000 to about 10,000, from about 3,000 to about 8,000, from about 3,000 to about 6,000, from about 3,000 to about 5,000, from about 3,000 to about 4,000, from about 3,000 to about 4,500, from about 3,350 to about 4,500, or from about 3,350 to about 4,000. In some embodiments, the PEG has a molecular weight of about 3350, about 4000, or about 4600. Suitable PEGs include, for example, PEG 1,000, PEG 2,000, PEG 3,000, PEG 3,350, PEG 3500, PEG 4,000, PEG 4,500, PEG 5,000, PEG 6,000, PEG 7,000, PEG 8,000, or combinations thereof.

Exemplary PEGs include, but are not limited those sold under the trade name CARBOWAX™ (Dow Chemical), such as CARBOWAX™ 1000, CARBOWAX™ 1450, CARBOWAX™ 3350, CARBOWAX™ 4000, CARBOWAX™ 4600, CARBOWAX™ 8000, or combinations thereof.

Suitable water soluble co-structuring agent also includes a polyethylene-polypropylene block copolymer having a molecular weight ranging from about 3,000 to about 12,000, from about 3,500 to about 11,000, from about 4,000 to about 10,000, from about 4,500 to about 9,500, from about 4,700 to about 8,400, or from about 5,500 to about 7,000.

Exemplary polyethylene-polypropylene block copolymers include, but are not limited to those sold under the trade name PLURONIC® (BASF), such as PLURONIC®-F38, PLURONIC®-F48, PLURONIC®-F58, PLURONIC®-F68, PLURONIC®-F77, PLURONIC®-F87, PLURONIC®-F88, or combinations thereof.

Suitable water soluble co-structuring agent also includes natural or semi-synthetic polymers, such as gellan gum, gelatin, casein, collagen, egg whites, guar gum, acia, tragacanth, bean gum, pectin, starch, xanthan gum, dextran, magnesium aluminum silicate (Veegum), methylcellulose, ethylcellulose, hydroxyethyl cellulose, hydroxypropyl cellulose, hydroxypropyl methylcellulose, carboxymethyl cellulose, or a mixture thereof. Suitable cellulosic material includes bacterial cellulose or microfibrous cellulose. Exemplary microfibrous celluloses are described in, for example, U.S. Pat. No. 7,776,807, US2008/0108541, US 2008/0146485, and WO2013160023, each of which is incorporated by reference in its entirety.

Suitable cellulosic material also includes parenchymal cellulose based materials (containing cell wall material and their networks of cellulose based fibers and nanofibrils) as described in WO 2014017913 and WO 2014142651, each of which is incorporated by reference in its entirety.

The amount of co-structuring agent in the solid gel composition is selected so as to have the desired gelling effect and hardness while minimizing the level of foaming. In some embodiments, the solid gel composition of present disclosure contains from about 0.1 wt % to about 65 wt %, from about 0.5 wt % to about 65 wt %, from about 0.5 wt % to about 60 wt %, from about 5 wt % to about 60 wt %, from about 10 wt % to about 55 wt %, from about 15 wt % to about 50 wt %, or from about 20 wt % to about 45 wt % calculated based on the total weight of the solid gel composition. In some embodiments, the solid gel composition contains up to about 65 wt %, preferably up to about 60 wt %, up to about 50 wt %, up to about 40 wt %, up to about 30 wt %, up to about 20 wt %, up to about 10 wt %, up to about 5 wt %, or up to about 1 wt % of a co-structuring agent calculated based on the total weight of the solid gel composition.

Non-Ionic Surfactants

The solid gel composition of the present disclosure contains a non-ionic surfactant. A wide range of non-ionic surfactants can be used herein. For example, the non-ionic surfactants include, but are not limited to alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof.

Preferably, the non-ionic surfactant is a low foaming non-ionic surfactant. Low foaming non-ionic surfactants are especially suitable for rinse aids, machine dishwashing applications.

The low foaming non-ionic surfactants desirably may have a cloud point (as measured at 1 wt % in water) between about 10° C. and about 60° C., between about 15 and about 55° C., or between about 20° C. and about 35° C.

Preferably, the solid gel composition of present disclosure comprises less than 50 wt % of a low foaming non-ionic surfactant. In some embodiments, the solid gel composition comprises greater than about 2.5 wt % of a low foaming non-ionic surfactant. In some embodiments, the solid gel composition comprises between about 2.5 and about 49 wt %, between about 5 and about 49 wt %, between about 10 and about 49 wt %, between about 15 and about 49 wt %, between about 20 and about 49 wt %, between about 25 and about 49 wt %, between about 30 and about 49 wt %, between about 35 and about 49 wt %, between about 15 and about 45 wt %, between about 20 and about 45 wt %, between about 20 and about 40 wt %, between about 20 and about 35 wt %, between about 20 and about 30 wt %, between about 25 and about 35 wt %, between about 25 and about 40 wt %, between about 30 and about 45 wt %, or between about 30 and about 40 wt % of a low foaming non-ionic surfactant calculated based on the total weight of the solid gel composition. In some embodiments, the solid gel composition comprises about 15 wt %, about 20 wt %, about 25 wt %, about 30 wt %, about 35 wt %, about 40 wt %, about 45 wt %, or about 48% of a low foaming non-ionic surfactant calculated based on the total weight of the solid gel composition.

Suitable non-ionic surfactant includes alkoxylated alcohols. Examples of alkoxylated alcohols of present disclosure include the condensation products of aliphatic $C_8$-$C_{20}$, preferably $C_8$-$C_{16}$, primary or secondary, linear or branched chain alcohols or phenols with alkylene oxides, e.g., ethylene oxide or propylene oxide, or a mixture of ethylene oxide and propylene oxide. In some embodiments, the alkoxylated alcohols contain 15 to 80, or 20 to 60, or 30 to 50 alkylene oxide groups. The surfactants may optionally be end-capped by a hydroxylated alkyl group In some embodiments, the alkoxylated alcohols have a hydrophilic-lipophilic balance (HLB) from 3 to 17, 6 to 15, or from 8 to 15.

In one embodiment, the alkoxylated alcohols have Formula (II):

$$R_1—(—O—CH_2—CH_2)_n—(—O—CH(CH_3)CH_2)_m—OH \quad \text{(IIA)}$$

$$R_1—(—O—CH(CH_3)—CH_2)_m—(—O—CH_2CH_2)_n—OH \quad \text{(IIB)},$$

wherein $R_1$ is a hydrocarbonyl group having 8 to 16 carbon atoms, 8 to 14 carbon atoms, 8 to 12 carbon atoms, or 8 to 10 carbon atoms; and n and m independently are from 0 to 40, 10 to 30, or 20 to 30, provided that the sum of n+m is at least 3.

The hydrocarbonyl group may be linear or branched, and saturated or unsaturated. In some embodiments, $R_1$ is a linear or branched $C_8$-$C_{16}$ alkyl or a linear or branched $C_8$-$C_{16}$ alkenyl groups. Preferably, $R_1$ is a linear or branched $C_8$-$C_{16}$ alkyl, $C_8$-$C_{14}$ alkyl, or $C_8$-$C_{10}$ alkyl groups. In case (e.g., commercially available materials) where materials contain a range of carbon chain lengths, these carbon numbers represent an average.

The alcohol may be derived from natural or synthetic feedstock. In one embodiment, the alcohol feedstock is coconut, containing predominantly $C_{12}$-$C_{14}$ alcohol, and oxo $C_{12}$-$C_{15}$ alcohols.

An example of a suitable alkoxylated alcohol is Plurafac® SLF-180 (available from BASF), or a modified polyalkoxylated alcohol Triton® DF-16 (available from Dow Chemical Company).

Another example of a suitable alkoxylated alcohol is Lutensol® AO 30 (available from BASF), which is a $C_{13}$-$C_{15}$ oxo alcohol having an average degree of ethoxylation of 30; and Lutensol® TO 20, which is an iso-$C_{13}$ alcohol having an average degree of ethoxylation of 20.

Another example of a suitable alkoxylated alcohol is Genapol® C200 (available from Clariant), which is a coco alcohol having an average degree of ethoxylation of 20.

Other alkoxylated alcohols suitable for present disclosure include those that have been marketed under the trade names Neodol® by the Shell Chemical Company and Lutensol® XP and Lutensol® XL grades manufactured by BASF.

The solid gel composition of present disclosure may contain non-ionic surfactants other than alkoxylated alcohols as described above. Suitable low foaming non-ionic surfactant also include polyoxyalkylene alkyl ethers of Formula (III):

$$R_2—(CH_2—CH_2—O)_x—(CH(CH_3)—CH_2—O)_y—R_3 \quad \text{(III A)}$$

$$R_2—(CH(CH_3)—CH_2—O)_y—(CH_2—CH_2—O)_x—R_3 \quad \text{(III B)},$$

in which, x and y are independently 0 to 20, or 0 to 15, provided that the sum of x and y is at least 3, 5, 6, 7, 8, 9 or 10; $R_2$ is a liner or branched alkyl or alkenyl group, preferably a $C_6$-$C_{22}$ liner or branched alkyl group; and $R_3$ is H or an optionally substituted (e.g., optionally hydroxylated) liner or branched alkyl or alkenyl group. Preferably, $R_3$ is H or a $C_1$-$C_6$ alkyl.

Suitable polyoxyalkylene alkyl ether non-ionic surfactants include those marketed under the trade name PLURONIC® (BASF), such as PLURONIC® PE or PLURONIC® RPE.

Other suitable nonionic surfactants include polyalkoxylated alkanolamides of Formula (IV):

$$R_4\overset{\overset{\displaystyle O}{\|}}{C}NR_6R_5(OR_7)_nH, \quad \text{(IV)}$$

wherein $R_4$ is an alkyl or hydroalkyl; $R_5$ and $R_7$ are alkyl; $R_6$ is hydrogen, an alkyl, a hydroalkyl group or a polyalkoxylated alkyl; and n is a positive integer. Preferably, $R_4$ is an alkyl containing 6 to 22 carbon atoms. $R_5$ is an alkyl containing 1-8 carbon atoms. $R_7$ is an alkyl containing 1 to 4 carbon atoms (e.g., n ethyl group). The degree of polyalkoxylation (the molar ratio of the oxyalkyl groups per mole of alkanolamide) typically ranges from about 1 to about 100, about 3 to about 8, or about 5 to about 6. The polyalkoxylated alkanolamide is typically a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil. Polyalkoxylated alkanolamides and preparation are described in, for example, U.S. Pat. Nos. 6,034,257 and 6,034,257, each of which is incorporated by reference herein in its entirety. Sources of fatty acids for the preparation of alkanolamides include beef tallow, palm kernel (stearin or olein) oil, coconut oil, soybean oil, canola oil, cohune oil, palm oil, white grease, cottonseed oil, mixtures thereof and fractions thereof. Other sources include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. Polyalkoxylated alkanolamides from one or more of these sources are within the scope of the present disclosure.

Other suitable nonionic surfactants of present disclosure include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Additional suitable surfactants include those disclosed in U.S. Pat. Nos. 5,945,394 and 6,046,149, each of which is incorporated herein by reference in its entirety.

Polar Organic Solvents

The solid gel composition of the present disclosure contains a polar organic solvent. Preferably, the solvent is fully miscible with water. Heating may be used during the manufacturing process to facilitate dissolution of the structuring agent and/or co-structuring agent in the solid gel precursor. Accordingly, the solvent is preferably one with a relatively low vapor pressure, so that the gel precursor can be heated without drying out too much. The solvent may have a vapor pressure of less than 1 kPa at 25° C. and 1 atm pressure, preferably less than 0.1 kPa, or less than 0.01 kPa under these conditions.

Suitable polar organic solvents include, but are not limited to ethylene glycol, propylene glycol, dipropylene glycol, butylene glycol, hexylene glycol, glycerin, tripropylene glycol, trimethylene glycol, diethylene glycol, sorbitol, ethanol, propanol, isopropanol, butanediol, an ester of citric acid, a polyethylene glycol having a molecular weight ranging from about 200 to about 600 (e.g., PEG-4, PEG-6, PEG-8, PPG-10, and PEG-12), or a mixture thereof.

In some embodiments, the polar organic solvent is a glycol, preferably an alkylene glycol (e.g., ethylene glycol, propylene glycol, butylene glycol, hexylene glycol, or a mixture thereof), or a dialkylene glycol (e.g., diethylene glycol, dipropylene glycol, dibutylene glycol, or a mixture thereof), or a trialkylene glycol (e.g., tripropylene glycol). In some embodiments, the polar organic solvent comprises propylene glycol, dipropylene glycol, or a mixture thereof. In some embodiments, the polar organic solvent may be propylene glycol, dipropylene glycol, tripropylene glycol, or a mixture thereof. Preferably, the polar organic solvent contains dipropylene glycol (DPG).

In some embodiments, the polar organic solvent of the present disclosure is an ester of citric acid having the Formula (V):

$$R_8O—C(CH_2CO_2R_9)_3 \quad (V),$$

in which $R_8$ is H or —C(O)$R_{10}$, each $R_9$ is independently an alkyl group, preferably a $C_1$-$C_5$ alkyl group, more preferably a $C_2$-$C_4$ alkyl group; and $R_{10}$ is an alkyl group, preferably a $C_1$-$C_5$ alkyl group, more preferably a $C_2$-$C_4$ alkyl group. Examples of such esters include trialkyl citrate, such as triethyl-, tripropyl- or tributyl-citrate, and trialkyl-2-acetyl-citrate, such as triethyl-, tripropyl- or tributyl-2-acetylcitrate.

In some embodiments, the solid gel composition of the present disclosure contains up to 70 wt % of the polar organic solvent. In some embodiments, the solid gel composition contains between about 10 wt % and about 70 wt %, between about 20 wt % and about 70 wt %, between about 30 wt % and about 70 wt %, between about 40 wt % and about 70 wt %, between about 50 wt % and about 70 wt %, or between about 50 wt % and about 60 wt % of the of the polar organic solvent calculated based on the total weight of the solid gel composition.

Water

The solid gel composition of the present disclosure also contains water. In some embodiments, the solid gel composition contains greater than about 3 wt %, or between about 3 wt % and about 40 wt %, between about 3 wt % and about 30 wt %, between about 5 wt % and about 30 wt %, between about 10 wt % and about 30 wt %, between about 12 wt % and about 25 wt %, between about 12 wt % and about 20 wt %, between about 15 wt % and about 30 wt %, between about 15 wt % and about 25 wt %, between about 15 wt % and about 20 wt %, between about 16 wt % and about 25 wt %, between about 16 wt % and about 20 wt %, between about 18 wt % and about 25 wt %, or between about 18 wt % and about 20 wt %, or about 4 wt %, about 5 wt %, about 6 wt %, about 7 wt %, about 8 wt %, about 9 wt %, about 10 wt %, about 11 wt %, about 12 wt %, about 13 wt %, about 14 wt %, about 15 wt %, about 16 wt %, about 17 wt %, about 18 wt %, or about 19 wt % of water calculated based on the total weight of the solid gel composition. Lower water content may increases the storage stability of the solid gel. However, higher water content may be desirable, for instance, to reduce cost.

A skilled artisan would appreciate that ratios between various components of the solid gel composition may be adjusted to achieve certain desired gel properties. For example, the weight ratio of the structuring agent and/or co-structuring agent to non-ionic surfactant, the weight ratio of the structuring agent and/or co-structuring agent to the polar organic solvent, and/or the weight ratio of the non-ionic surfactant to the polar organic solvent may be adjusted.

Other Ingredients

The solid gel composition of present disclosure can further contain one or more other ingredients for assisting or enhancing cleaning performance, or for modify the aesthetics of the composition, etc. These ingredients are known in the art for dishwashing applications, which include, but are not limited to a colorant (dye), an enzyme, a fragrance (a free fragrance and/or an encapsulated fragrance), a corrosion inhibitor, a chlorine scavenger, a water softener, a rinse aid, a bittering agent, or a combination thereof. The following are illustrative examples of such ingredients.

All dyes suitable for use in detergent (e.g., dishwashing) composition can be used in herein. A variety of dye colors can be used in the solid gel, such as blue, yellow, green, orange, purple, clear, etc. Suitable dyes include, but are not limited to chromophore types, e.g., azo, anthraquinone, triarylmethane, methine quinophthalone, azine, oxazine thiazine, which may be of any desired color, hue or shade, including those described elsewhere herein. Suitable dyes can be obtained from any major supplier such as Clariant, Ciba Speciality Chemicals, Dystar, Avecia or Bayer. In some embodiments, the colorant is Liquitint® Blue HP (available from Milliken Chemical), which can be added in the form of a 1% aqueous dye solution (i.e., 1% active dye and 99% water).

Exemplary solid gel composition of present disclosure contains from about 30 to about 85 wt % (e.g., about 50 wt %) dipropylene glycol; from about 2.5 to about 49 wt % (e.g., about 25 wt %) of a non-ionic surfactant (e.g., alkoxylated alcohol), from about 8 to about 30 wt % (e.g., about 18 wt %) deionized water; from about 1 to about 10 wt % (e.g., about 5 wt %) sodium stearate; and from about 0.1 wt % to about 5 wt % (e.g., as about 1% in aqueous solution) of colorant.

Other exemplary solid gel formulations of this disclosure are described in the Examples below.

Solid Gel Properties

It has been surprisingly discovered that the solid gel of present disclosure has desirable hardness (gel hardness as expressed in Newton, N). In unit dose application, gel hardness is important for the product to maintain the desired shape during manufacturing, shipping and handling so that the consumer is provided with an aesthetically pleasing product. Thus, it is required and advantageous that the solid gel in the unit dose has sufficient hardness so that it does not deform. It is also important that the solid gel in the unit dose does not migrate to (bleed to) the solid cleaning phase with which it has a direct contact.

Preferably, the solid gel of the present disclosure has a hardness between about 10 N and about 500 N, between about 10 N and about 400 N, between about 10 N and about 300 N, between about 20 N and about 300 N, between about 30 N and about 300 N, between about 40 N and about 300 N, between about 50 N and about 300 N, or between about 60 N and about 300 N, either measured on a circular solid gel sample with dimensions of 1 inch diameter×0.5 inch thickness, or 1 inch diameter×0.15 inch thickness, using a force analyzer. Hardness of the solid gel may vary with gel shape and method of its preparation. For example, when measured by a force analyzer, a solid gel having an oval shape and a circular shape with approximately same thickness may have different hardness. The detailed description of hardness measurement is provided in Example below.

The solid gel of the present disclosure is self-standing, and does not flow at room temperature and pressure (e.g., 20° C., 1 atm pressure).

In some embodiments, the solid gel composition has a melting temperature between about 50° C. and about 85° C., between about 55° C. and about 75° C., or between 60° C. and 75° C., when measured by DSC at a heating rate of 10° C./minute.

In some embodiment, the solid gel composition of present disclosure has a solidification temperature between about 35° C. and about 70° C., between about 40° C. and about 60° C., or between 45° C. and 60° C., when measured by DSC at a cooling rate of 10° C./minute.

The majority of the cleaning provided by the unit dose dishwashing detergent composition of the present disclosure may come from the solid cleaning composition. The ratio of solid cleaning composition to solid gel composition in each water-soluble single-compartment container (e.g., pouch) can vary, but sufficient cleaning power is needed to provide ample cleaning. The unit dose dishwashing detergent composition can contain from about 50 wt % to about 95 wt % of the solid cleaning composition and from about 5 wt % to about 50 wt % of the solid gel composition calculated based on a total weight of the unit dose composition.

In some embodiments, the unit dose dishwashing detergent composition can contain solid cleaning composition and solid gel composition at a weight ratio of (the solid cleaning composition:solid gel composition) from about 10:1 to 1:1, from about 8:1 to 1:1, from about 4:1 to 1:1, from about 3:1 to 1:1, from about 7:3 to 1:1, or from about 3:2 to 1:1. For example, the weight ratio (the solid cleaning composition/solid gel composition) can be about 90/10, about 89/11, about 88/12, about 87/13, about 86/14, or about 82/18. In some embodiments, the weight ratio (the solid cleaning composition/solid gel composition) is about 86/14, about 87/13, about 88/12, or about 89/11.

For maximum cleaning and aesthetic balance, the solid cleaning composition is included between about 70 wt % to about 90 wt %, and the solid gel composition is included between about 10 wt % to about 30 wt % calculated based on a total unit dose composition. Other ratios suitable for unit dose dishwashing detergent composition of the present disclosure will be apparent from the disclosure herein.

The unit dose dishwashing detergent composition according to any one of the above embodiments is formulated so as to be suitable for removing soils from soiled dishware in an automatic dishwashing machine. In some embodiments, the solid gel composition is formulated to dissolve more slowly than the solid cleaning composition, or the solid gel composition is formulated to dissolve at a higher temperature, such as that in the rinse cycle of dishwashing. This can be beneficial for instance in releasing the surfactant rinse-aid later in the wash cycle.

In preferred embodiments, the unit dose dishwashing detergent composition of the present disclosure, when used for removing soils from soiled dishware in an automatic dishwashing machine, results in reduced spotting and filming on the washed dishware.

II. Unit Dose Fabric Cleaning or Treating Composition

In another aspect, the present disclosure provides a unit dose fabric cleaning or treatment composition comprising: (i) a water-soluble single-compartment container defining a single compartment; (ii) a solid cleaning or booster composition comprising one or more components selected from the group consisting of a detersive surfactant, a clay, a salt, an enzyme, a chelating agent, a bleach, a bleach activator, a bleach catalyst, a silicone, a soil release polymer, an anti-redeposition polymer, a fragrance, an encapsulated fragrance a cooling agent, a colorant, a shading dye, an optical brightener, a whitening agent, and a combination thereof; and (iii) a solid gel composition. The solid cleaning or booster composition and the solid gel composition are contained in the single compartment, and the solid cleaning or booster composition is in direct contact with the solid gel composition. Preferably, there is little or no visible intermixing occurring at the interphase between the solid cleaning or booster composition and the solid gel composition.

The solid gel composition has one or more of the following characteristics: (1) the solid gel has a hardness between about 10 N and about 500 N, between about 10 N and about 400 N, between about 10 N and about 300 N, between about 20 N and about 300 N, between about 30 N and about 300 N, between about 40 N and about 300 N, between about 50 N and about 300 N, or between about 60 N and about 300 N, when measured on a circular solid gel sample with dimensions of 1 inch diameter×0.5 inch thickness, or 1 inch diameter×0.15 inch thickness, using a force analyzer; (2) the solid gel has a solidification temperature between about 35° C. and about 70° C., or between about 40° C. and about 60° C., when measured by DSC at a cooling rate of 10° C./minute; and (3) the solid gel has a melting temperature between about 50° C. and about 85° C., or between about 55° C. and about 75° C., when measured by DSC at a heating rate of 10° C./minute.

The unit dose fabric cleaning or treatment composition according to any one of the embodiments described herein is formulated so as to be suitable for cleaning fabric, or providing fabric care or sensorial benefits (such as a fragrance booster, or for in-wash softening, malodor control, whitening, color protection) to fabric in an automatic fabric-laundering machine.

Water-Soluble Single-Compartment Container

The unit dose fabric cleaning or treatment composition of the present disclosure comprises a water-soluble single-compartment container defining a single compartment as described above.

Solid Cleaning or Booster Composition

The unit dose fabric cleaning or treatment composition of the present disclosure comprises a solid cleaning or booster composition containing one or more components known in the art suitable for fabric cleaning and treatment. The components include, but are not limited to a detersive surfactant, a clay, a salt, an enzyme, a chelating agent, a bleach, a bleach activator, a bleach catalyst, a silicone, a grease or soil release polymer, an anti-redeposition polymer, a fragrance, an encapsulated fragrance, a cooling agent, a colorant, a shading dye, an optical brightener, a whitening agent, a fabric softener, or a combination thereof.

All detersive surfactants known in the art suitable for use in fabric cleaning can be used for the solid cleaning composition described herein. The surfactants include, but are not limited to an anionic surfactant, a nonionic surfactant, a cationic surfactant, a zwitterionic surfactant (amphoteric surfactant), or mixtures thereof.

Nonionic Surfactant

Suitable nonionic surfactants may include those as described above for the solid gel composition for the unit dose dishwashing detergent composition.

Anionic Surfactants

Suitable anionic surfactants include those surfactants that contain a long chain hydrocarbon hydrophobic group in their molecular structure and a hydrophilic group, i.e., water solubilizing group including salts such as carboxylate, sulfonate, sulfate or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group. Examples of such anionic surfactants include water soluble salts of alkyl benzene sulfonates having between 8 and 22 carbon atoms in the alkyl group, alkyl ether sulfates having between 8 and 22 carbon atoms in the alkyl group. In one embodiment, the anionic surfactant comprises an alkali metal salt of $C_{10-16}$ alkyl benzene sulfonic acids, or $C_{11-14}$ alkyl benzene sulfonic acids. In one embodiment, the alkyl group is linear and such linear alkyl benzene sulfonates are known as "LAS." Alkyl benzene sulfonates, and particularly LAS, are well known in the art. Other suitable anionic surfactants include:

sodium and potassium linear straight chain alkylbenzene sulfonates in which the average number of carbon atoms in the alkyl group is from 11 to 14 (e.g., sodium $C_{12}$ LAS).

In one embodiment, the anionic surfactants include polyethoxylated alcohol sulfates, such as those sold under the tradename CALFOAM® 303 (Pilot Chemical Company, California). Such surfactants (also known as alkyl ether sulfates or alkyl polyethoxylate sulfates) are those of Formula (VI):

$$R_{11}—O—(C_2H_4O)_n—SO_3M \quad (VI),$$

wherein $R_{11}$ is a $C_8$-$C_{22}$ alkyl group, n is from 1 to 20, and M is a salt-forming cation. Preferably, $R_{11}$ is $C_{10}$-$C_{18}$ alkyl, or $C_{10}$-$C_{15}$ alkyl, n is from 1 to 15, 1 to 10, or 1 to 8, and M is sodium, potassium, ammonium, alkylammonium, or alkanolammonium. More preferably, $R_{11}$ is a $C_{12}$-$C_{16}$ alkyl, n is from 1 to 6, and M is sodium. The alkyl ether sulfates will generally be used in the form of mixtures comprising varying $R_{11}$ chain lengths and varying degrees of ethoxylation. Frequently such mixtures will inevitably also contain some unethoxylated alkyl sulfate materials, i.e., n=0 in the above Formula (VI). In one embodiment, the alkyl ether sulfate is sodium lauryl ether sulphate (SLES). Unethoxylated alkyl sulfates may also be added separately to the compositions of present disclosure and used as or in any anionic surfactant component which may be present. Suitable unalkoyxylated, e.g., unethoxylated, alkyl ether sulfate surfactants are those made by the sulfation of higher $C_8$-$C_{20}$ fatty alcohols. Conventional alkyl sulfate surfactants may also be suitable herein, which have the general formula of: $R_{11}OSO_3M+^+$, wherein $R_{11}$ and M each has the same definition as described above.

In one embodiment, the anionic surfactant is an α-sulfofatty acid ester having Formula (VII):

$$R_{12}CH(SO_3R_{14})COOR_{13}, \quad (VII)$$

wherein $R_{12}$ is a linear or branched alkyl, $R_{13}$ is a linear or branched alkyl, and $R_{14}$ is hydrogen, a halogen, a monovalent or di-valent cation, or an unsubstituted or substituted ammonium cation. $R_{12}$ can be a $C_4$-$C_{24}$ alkyl, including a $C_8$, $C_{10}$, $C_{12}$, $C_{14}$, $C_{16}$ and/or $C_{18}$ alkyl. $R_{13}$ can be a $C_1$-$C_8$ alkyl, including a methyl group. $R_{14}$ is a mono-valent or di-valent cation, such as a cation that forms a water soluble salt with the α-sulfofatty acid ester (e.g., an alkali metal salt such as sodium, potassium or lithium). In preferred embodiments, $R_{14}$ is a monovalent metal cation (e.g., $Li^+$, $Na^+$ or $K^+$). The α-sulfofatty acid ester of Formula (VII) can be a methyl ester sulfonate, such as a $C_{16}$ methyl ester sulfonate, a $C_{18}$ methyl ester sulfonate, or a mixture thereof. In one embodiment, the α-sulfofatty acid ester of formula (VII) is a methyl ester sulfonate, such as a mixture of $C_{12}$-$C_{18}$ methyl ester sulfonates. The above α-sulfofatty acid can be formed by esterifying a carboxylic acid with an alkanol and then sulfonating the α-position of the resulting ester.

In some embodiment, the anionic surfactant is at least one α-sulfofatty acid ester. For example, the α-sulfofatty acid ester can be a $C_{10}$, $C_{12}$, $C_{14}$, $C_{16}$ or $C_{18}$ α-sulfofatty acid ester. In one embodiment, the α-sulfofatty acid ester comprises a mixture of sulfofatty acids. For example, the composition can comprise a mixture of α-sulfofatty acid esters, such as $C_{10}$, $C_{12}$, $C_{14}$, $C_{16}$ and Cis sulfofatty acids. The proportions of different chain lengths in the mixture are selected according to the properties of the α-sulfofatty acid esters. For example, $C_{16}$ and Cis sulfofatty acids (e.g., from tallow and/or palm stearin MES) generally provide better surface active agent properties, but are less soluble in aqueous solutions. $C_{10}$, $C_{12}$ and $C_{14}$ α-sulfofatty acid esters (e.g., from palm kernel oil or coconut oil) are more soluble in water, but have lesser surface active agent properties. Suitable mixtures include $C_8$, $C_{10}$, $C_{12}$ and/or $C_{14}$ α-sulfofatty acid esters with $C_{16}$ and/or $C_{18}$ α-sulfofatty acid esters. For example, about 1 to about 99 percent of $C_8$, $C_{10}$, $C_{12}$ and/or $C_{14}$ α-sulfofatty acid ester can be combined with about 99 to about 1 weight percent of $C_{16}$ and/or $C_{18}$ α-sulfofatty acid ester. In one embodiment, the mixture comprises about 1 to about 99 weight percent of a $C_{16}$ or $C_{18}$ α-sulfofatty acid ester and about 99 to about 1 weight percent of a $C_{16}$ or Cis α-sulfofatty acid ester. In one embodiment, the α-sulfofatty acid ester is a mixture of Cis methyl ester sulfonate and a $C_{16}$ methyl ester sulfonate and having a ratio of about 2:1 to about 1:3. Particularly preferred are combinations of $C_{16}$ methyl ester sulfonate (MES) and Cis MES, particularly eutectic MES (referred to herein as EMES) which has a C16:C18 ratio of about 50:50 to about 70:30 (for example, about 50:50, about 55:45, about 60:40, about 65:35, about 70:30, about 75:25, or about 80:20, and most particularly a C16:C18 ratio of about 70:30).

Examples of other anionic surfactants are disclosed in U.S. Pat. No. 3,976,586, which is incorporated by reference herein.

Zwitterionic Surfactants and Amphoteric Surfactants

Suitable zwitterionic surfactants include derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein.

Suitable amphoteric surfactants for uses herein include amido propyl betaines and derivatives of aliphatic or heterocyclic secondary and ternary amines in which the aliphatic moiety can be straight or branched chain, and wherein one of the aliphatic substituents contains from 8 to 24 carbon atoms and at least one aliphatic substituent contains an anionic water-solubilizing group.

Cationic Surfactants

Suitable cationic surfactants include quaternary ammonium surfactants, e.g., quaternary ammonium surfactants are selected from the group consisting of mono $C_6$-$C_{16}$, or $C_6$-$C_{10}$ N-alkyl or alkenyl ammonium surfactants, wherein the remaining N positions are substituted by methyl, hydroxyethyl or hydroxypropyl groups. Another cationic surfactant is $C_6$-$C_{18}$ alkyl or alkenyl ester of a quaternary ammonium alcohol, such as quaternary chlorine esters. In one embodiment, the cationic surfactants have the Formula (VIII):

$$X—[(N^+R_{15}CH_3CH_3)—(CH_2CH_2O)_nH] \quad (VIII),$$

wherein $R_{15}$ is $C_8$-$C_{18}$ hydrocarbyl, X is an anion, or mixtures thereof. Preferably, $R_{15}$ is $C_{8-14}$ alkyl (e.g., $C_8$, $C_{10}$ or $C_{12}$ alkyl), and X is chloride or bromide.

In some embodiments, the surfactant comprises a mixture of at least one anionic and one nonionic surfactant. In one embodiment, the anionic surfactant is an alkyl benzene sulfonate. In some embodiments, the surfactant comprises a mixture of at least two anionic surfactants. In one embodiment, the surfactant comprises a mixture of an alkyl benzene sulfonate, an α-sulfofatty acid ester salt (e.g., salt of methyl ester sulfonate), and an alkyl ether sulfate (e.g., sodium lauryl ether sulphate (SLES)).

In some embodiments, the surfactant comprises a mixture of at least one anionic surfactant and at least one non-ionic surfactant. For example, the solid cleaning composition may comprises from about 5 to about 50 wt % of an anionic surfactant selected from the group consisting of alkyl benzene sulfonate, methyl ester sulfonate, sodium lauryl ether sulphate, and mixtures thereof, and from about 1 to about 20 wt % of an ethoxylated alcohol.

Other Ingredients

The solid cleaning or booster composition may also contain one or more other ingredients including a clay, a salt, an enzyme, a chelating agent, a bleach, a bleach activator, a bleach catalyst, a silicone, a soil release polymer, an anti-redeposition polymer, a fragrance, an encapsulated fragrance, a malodor control agent, a cooling agent, a colorant, a shading dye, an optical brightener, a whitening agent, and a fabric softener.

Suitable silicones, enzymes, grease or soil release polymers, anti-redeposition polymers, fragrances (free or encapsulated), and colorants (dyes) are as described above. The following are illustrative examples of other ingredients.

Suitable salts include an organic or inorganic salt, such as a salt contains a potassium, sodium or calcium cation, and a citrate, maleate, succinate, chloride anion. An exemplary salt is NaCl.

Compounds that yield $H_2O_2$ in water may serve as bleaching agents. Suitable bleach agents include, but are not limited to sodium perborate tetrahydrate, sodium perborate monohydrate, sodium percarbonate, peroxypyrophosphates, citrate perhydrates, perbenzoates, peroxophthalates, diperazelaic acid, phthaloiminoperacid, diperdodecane dioic acid and the like.

Other suitable bleach agents include diacyl peroxides (such as dibenzoyl peroxide), or peroxy acids (such as alkyl peroxy acids and aryl peroxy acids). Representative bleach agents include: (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Additional suitable bleaching agents include chlorine- and bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof (e.g., potassium and sodium salts). Hydantoin compounds, such as 1,3-dichloro-5,5-dimethyl hydantoin, are also suitable.

In order to obtain an improved bleaching effect where washing is carried out at temperatures of 60° C. or lower, bleach activators may also be incorporated. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing 0- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhydrides, more particularly phthalic anhydride, acylated polyhydric alcohols, more particularly triacetin, ethylene glycol diacetate and 2,5-diacetoxy-2,5-dihydrofuran.

In addition to or instead of the bleach activators above, a bleach catalyst may also be incorporated. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

The optical brighteners normally present in laundry detergents may be used herein. Examples of optical brighteners are derivatives of diamino-stilbenedisulfonic acid or alkali metal salts thereof, oxazole derivatives, or coumarin brighteners. Suitable optical brighteners include, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, such as alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, may be included. Mixtures of the brighteners mentioned above may also be used. Exemplary optical brighteners include TINOPAL® AMS, TINOPAL® CBS-X, TINOPAL® RA-16 (available from Ciba Geigy).

Solid Gel Composition

The solid gel composition in the unit dose fabric cleaning or treatment composition comprises: (a) water, or a polar organic solvent, or a combination thereof; and (b) a water soluble structuring agent, or a water soluble co-structuring agent, or a combination thereof.

Water, polar organic solvent, water soluble structuring agent, and water soluble co-structuring agent (types and amount) are described above.

For example, the structuring agent comprises a $C_{12}$-$C_{22}$ fatty acid salt, or a mixture of $C_{12}$-$C_{22}$ fatty acid salts, and is present in an amount ranging from about 0.5 wt % to about 15 wt % calculated based on the total weight of the solid gel composition.

The co-structuring agent comprises polyethylene glycol, a polyethylene-polypropylene block copolymer, polyvinyl alcohol, polyvinyl pyrollidone, a natural or semi-synthetic polymer, or a mixture thereof, wherein the natural or semi-synthetic polymer is selected from the group consisting of gellan gum, gelatin, casein, collagen, egg whites, guar gum, acia, tragacanth, bean gum, pectin, starch, xanthan gum, dextran, magnesium aluminum silicante (Veegum), methylcellulose, ethylcellulose, hydroxyethyl cellulose, hydroxypropyl cellulose, hydroxypropyl methylcellulose, and carboxymethyl cellulose, or a mixture thereof, and is present in an amount from about 0.5 wt % to about 95 wt % calculated based on the total weight of the solid gel composition.

The polar organic solvent comprises a monohydric or a polyhydric alcohol, a glycol, an alkylene glycol, a dialkylene glycol, a trialkylene glycol, a polyethylene glycol, or a mixture thereof, is present in an amount from 2 wt % to about 65 wt % calculated based on the total weight of the solid gel composition.

Water is present in an amount between about 3 wt % and about 30 wt % calculated based on the total weight of the solid gel composition.

The solid gel composition may further comprise an anionic surfactant, a zwitterionic surfactant, a non-ionic surfactant, a free fragrance, an encapsulated fragrance, a silicone, an anti-redeposition polymer, a grease or soil release polymer (such as polyethyleneimine polymer, modified polyethyleneimine polymer), an enzyme, a malodor control agent (such as zinc ricinoleate), a dye (such as a shading dye, a whitening agent), a dye transfer inhibitor, or a combination thereof. These additional ingredients are either known in the art or are described above.

The solid gel has a hardness between about 10 N and about 500 N, between about 10 N and about 400 N, between about 10 N and about 300 N, between about 20 N and about 300 N, between about 30 N and about 300 N, between about 40 N and about 300 N, between about 50 N and about 300 N, or between about 60 N and about 300 N, either measured on a circular solid gel sample with dimensions of 1 inch diameter×0.5 inch thickness, or 1 inch diameter×0.15 inch thickness, using a force analyzer, such as a Tinius Olsen H5KT Force Analyzer. Hardness of the solid gel may vary with gel shape and method of its preparation.

The solid gel of the present disclosure is self-standing, and does not flow at room temperature and pressure (e.g., 20° C., 1 atm pressure).

In some embodiments, the solid gel composition has a melting temperature between about 50° C. and about 85° C., between about 55° C. and about 75° C., or between 60° C. and 75° C., when measured by DSC at a heating rate of 10° C./minute.

In some embodiment, the solid gel composition of present disclosure has a solidification temperature between about 35° C. and about 70° C., between about 40° C. and about 60° C., or between 45° C. and 60° C., when measured by DSC at a cooling rate of 10° C./minute.

The unit dose fabric cleaning or treatment composition may additionally contain one or more beneficial ingredients, including a biocidal agent, a foam stabilizing agent, a corrosion inhibitor, a water softener, a chlorine scavenger, an anti-oxidant, an anti-slip agent, a pH adjusting agent, a UV absorber, a bitter agent, or a combination thereof. Each of these agents is known in the art.

In some embodiments, the unit dose fabric cleaning or treatment composition can contain the solid cleaning or booster composition and solid gel composition at a weight ratio of (the solid cleaning or booster composition:solid gel composition) from about 10:1 to 1:1, from about 8:1 to 1:1, from about 4:1 to 1:1, from about 3:1 to 1:1, from about 7:3 to 1:1, or from about 3:2 to 1:1.

In one embodiment, the unit dose fabric cleaning or treatment composition of the present disclosure contains: (1) a solid cleaning or booster composition comprising a salt (such as NaCl) and/or a fragrance (such as fragrance oil); and (2) the solid gel composition comprising: (a) water, or a polar organic solvent, or a combination thereof; and (b) a water soluble structuring agent, or a water soluble co-structuring agent, or a combination thereof; and (c) a fragrance (such as an encapsulated fragrance). The unit dose may be used as a fragrance booster.

In one embodiment, the unit dose fabric cleaning or treatment composition of the present disclosure contains: (1) a solid cleaning or booster composition comprising a clay (such as bentonite clay) and/or cationic cellulose (such as polyquaternium-10); and (2) the solid gel composition comprising: (a) water, or a polar organic solvent, or a combination thereof; and (b) a water soluble structuring agent, or a water soluble co-structuring agent, or a combination thereof; and (c) a silicone and/or a fragrance oil. The unit dose provides in-wash softening benefits.

In one embodiment, the unit dose fabric cleaning or treatment composition of the present disclosure contains: (1) a solid cleaning or booster composition comprising a soil release polymer (such as Clariant Texcare SRN 300F, Texcare SRN 100, or Texcare SRN 170), and/or an enzyme, and/or a fluorescent whitening agent, and/or a shading dye; and (2) the solid gel composition comprising: (a) water, or a polar organic solvent, or a combination thereof; and (b) a water soluble structuring agent, or a water soluble co-structuring agent, or a combination thereof; and (c) a non-ionic surfactant and/or a soil release polymer. The unit dose may be used as a stain removal booster.

In one embodiment, the unit dose fabric cleaning or treatment composition of the present disclosure contains: (1) a solid cleaning or booster composition comprising a bleach system (containing a bleach agent (such as percarbonate), a bleach activator (such as PAP or TAED) and/or manganese bleach catalyst), and/or a malodor control agent (such as zinc ricinoleate); and (2) the solid gel composition comprising: (a) water, or a polar organic solvent, or a combination thereof; and (b) a water soluble structuring agent, or a water soluble co-structuring agent, or a combination thereof; and (c) a non-ionic surfactant and/or a fragrance. The unit dose can provide malodor control, stain removal, whitening, and/or sanitizing benefits.

In one embodiment, the unit dose fabric cleaning or treatment composition of the present disclosure contains: (1) a solid cleaning or booster composition comprising an enzyme (such as a cellulase enzyme), and/or a chelating agent, and/or an anti-redeposition polymer; and (2) the solid gel composition comprising: (a) water, or a polar organic solvent, or a combination thereof; and (b) a water soluble structuring agent, or a water soluble co-structuring agent, or a combination thereof; and (c) a silicone and/or a fragrance. The unit dose can provide fabric care benefit.

Solid Gel Preparation

The solid gel (either in the unit dose dishwashing composition or unit dose fabric cleaning and treatment composition) of the present disclosure may be made by any suitable method known to those skilled in the art. For example, the ingredients of a solid gel composition may be combined with heating to form a pourable fluid, the molten fluid is poured into a mold with desired shape and the gel is allowed to solidify to form a self-standing gel upon cooling.

The range of heating is dependent on different components and their concentrations in a solid gel composition. The temperature to which a solid gel formulation is heated has to be hot enough to melt all the ingredients, but not too hot to vaporize a significant portion of water or solvent contained therein. Thus, changing the solid gel composition will change manufacture conditions. The melting and solidification temperate of the solid gel are integral to making the compositions of the present disclosure as described herein and in particular in Examples below.

When making a solid gel for the unit dose dishwashing composition, the water soluble structuring agent and/or co-structuring agent, at least some or all of the non-ionic surfactant, and at least some or all of the water and/or organic solvent, are combined with stirring at 10 to 40° C. to form a mixture, which may be then heated to 50-85° C., or 55-75° C. to form a fluid. The fluid is poured into the appropriate molds and then cooled to form a solid self-standing gel.

When less than all of the ingredients of the solid gel composition are included in the mixing step, the remainder ingredients may be added during or after the heating step. For example, when a colorant is included, it can be added to the heated mixture as a premix with water, polar organic solvent and/or non-ionic surfactant.

The solid gel mixture may be thixotropic. For ease of processing, the viscosity of the resulting fluid at the end of the heating may desirably be less than 10,000 mPa·s, less than 5000 mPa·s, less than 1000 mPa·s, less than 500 mPa·s, or less than 200 mPa·s, as measured with a Brookfield viscometer.

In some embodiments, the solid gel of the present disclosure may comprises a sufficient amount of entrapped (incorporated) air or gaseous materials. The gaseous material is incorporated or entrapped by any suitable methods, including but not limited to, aeration, sparging, and agitation. Aeration of a solid gel composition can increases water solubility and/or provide a faster dissolution of the solid gel composition as compared with a non-aerated reference solid gel composition.

In some embodiments, a sufficient amount of air or gaseous material is entrapped to decrease the density of the composition by at least about 1%, or by at least about 2%, or by at least about 3%, or by at least about 4%, or by at least about 5%, or by at least about 6%, or by at least about 7%, or by at least about 8%, or by at least about 9%, or by at least about 10%, or by at least about 11%, or by at least about 12%, or by at least about 13%, or by at least about 14%, or by at least about 15%, or by at least about 16%, or by at least about 17%, or by at least about 18%, by at least about 19%, or by at least about 20%, as compared to a reference solid gel composition without entrapped air. The term "reference solid gel composition" refers an otherwise identical composition but without entrapped air.

In some embodiments, a sufficient amount of air or gaseous material is entrapped to increase the volume by from about 0.1% to about 300%, from about 0.1% to about 200%, from about 0.1% to about 100%, or from about 0.1% to about 50%, as compared to a reference solid composition without entrapped air.

Unit Dose Compositions

The water-soluble single-compartment container (e.g., pouch) of the present disclosure may be in any desired shape and size and may be prepared by any suitable methods, such as via molding, casting, extruding or blowing. The container is then filled using an automated filling process. Examples of processes for producing and filling water-soluble containers are described in, for example, U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290, each of which is incorporated herein by reference in its entirety.

In practice, if a solid gel is to be shaped or contoured, then it is first filled into a shaped or contoured mold/cavity containing a container material (such as a PVOH film) in liquid form, allowed to cool to solidify, and then a solid cleaning or booster composition (such as a powder phase) is filled in the same container. Preferably, the gel is filled in a liquid form at about 45 to 60° C., and remains in a liquid from during filling, but will quickly solidify prior to coming in contact with the powder phase. In order to prevent clogging of pumps, nozzles, and other processing machineries, the solid gel composition preferably has a lower viscosity.

In addition, one or more solid gel phases and one or more solid cleaning or booster phases can be introduced or layered into the unit dose composition of the present disclosure.

One of the advantages of the unit dose of present disclosure is that the solid gel composition and the solid cleaning composition (dishwashing), or the solid gel composition and the solid cleaning or booster composition (fabric cleaning or treatment) can be combined in a single pouch with minimal phase migration.

Use

The present disclosure also provides methods of removing soils from soiled dishware, for example, by placing the soiled dishware into the chamber of an automatic dishwashing machine that contains at least one dosing compartment; placing at least one of the unit dose dishwashing detergent composition of the present disclosure into the dosing compartment; introducing water into the chamber of the machine; and washing the dishware in an aqueous environment in the machine under conditions favoring the release of the cleaning system into the chamber of the machine such that the components of the cleaning system contact the dishware and remove the soils from the dishware.

Soils that can be removed from dishware using the compositions and methods disclosed herein include, but are not limited to, oil-containing soils, carbohydrate-containing soils, protein-containing soils, tannin-containing soils and particulate soils.

Spotting is a key factor when determining the performance of an automatic dishwashing detergent. The appearance of spots or film on dishware (especially glassware) is undesirable and must be addressed by the addition of a rinse agent to the detergent composition. It has been surprisingly discovered that the unit dose dishwashing detergent composition of the present disclosure results in reduced or no spotting of dishware. Non-ionic surfactants in the solid gel of the present disclosure may provide reduced spotting and filming in the dishwashing process, as non-ionic surfactants have low sudsing profile and wetting characteristics by breaking down the surface tension of water. The wetting characteristics provide a rinse aid effect that would allow water to sheet of dishes and dry in spot. Spotting and filming evaluations are described and illustrated in Examples below.

In some embodiments, the solid gel in the unit dose dishwashing composition is formulated and prepared to dissolve or disintegrate completely during a single cycle of the dishwasher. For such applications, it is advantageous if the solid gel dissolves quickly in the wash, so that the active ingredients can start to work at an early stage of cleaning.

The present disclosure also provides methods of cleaning fabric, or providing fabric care or sensorial benefits to fabric in an automatic fabric-laundering machine, for example, by placing the fabric into the chamber of an automatic fabric-laundering machine that contains at least one dosing compartment; placing at least one of the unit dose fabric cleaning or treatment composition of the present disclosure into the dosing compartment; introducing water into the chamber of the machine; and washing or treating the fabric in an aqueous environment in the machine under conditions favoring the release of the cleaning system or fabric care system into the chamber of the machine such that the components of the cleaning system or fabric care system contacts the fabric and removes the soils from the fabric, or provides fabric care or sensorial benefits to the fabric. The fabric care or sensorial benefits include fragrance boosting, in-wash softening, malodor control, whitening, or color protection.

The following examples are illustrative and non-limiting, of the device, products and methods of the present invention. Suitable modifications and adaptations of the variety of conditions, formulations and other parameters normally encountered in the field and which are obvious to those skilled in the art in view of this disclosure are within the spirit and scope of the invention.

EXAMPLES

Example 1: Solid Gel Formulation Containing Plurafac® SLF-180

A solid gel composition for a unit dose dishwashing detergent composition according to the present disclosure was prepared based on the following formula:

| Ingredient | Function | Weight % |
|---|---|---|
| Dipropylene Glycol | Solvent | 51.225 |
| Plurafac ® SLF-180 | Non-ionic Surfactant | 25.0 |
| DI Water | | 18.750 |
| Sodium Stearate | Structuring Agent | 5.0 |
| LT Blue HP | Colorant | 0.025 |
| Total | | 100 |

To make solid gel, dipropylene glycol, Plurafac® SLF-180 and deionized water were admixed at room temperature, and heated to about 80° C. Sodium stearate was then added and the mixture was stirred until all of the sodium stearate was dissolved. Colorant was then added. The solution was mixed well to achieve a uniform color. The mixture was poured into a mold. Upon cooling, a solid gel was formed.

Example 2: Solid Gel Formulation Containing Triton® DF-16

A solid gel composition for a unit dose dishwashing detergent composition according to the present disclosure was prepared based on the following formula:

| Ingredient | Function | Weight % |
|---|---|---|
| Dipropylene Glycol | Solvent | 51.225 |
| Triton ® DF-16 | Non-ionic Surfactant | 25.0 |
| DI Water | | 18.750 |
| Sodium Stearate | Structuring Agent | 5.0 |
| LT Blue HP | Colorant | 0.025 |
| Total | | 100 |

By employing the similar method as described above in Example 1, a solid gel was obtained.

Example 3: Solid Gel Formulations Containing PEG 3350

Two solid gel compositions containing PEG as a co-structuring agent according to the present disclosure were prepared based on the following formulae:

| Ingredient | Function | Weight % |
|---|---|---|
| Dipropylene Glycol | Solvent | 46.225 |
| Triton ® DF-16 | Non-ionic Surfactant | 25.0 |

-continued

| Ingredient | Function | Weight % |
|---|---|---|
| DI Water | | 18.750 |
| Sodium Stearate | Structuring Agent | 5.0 |
| Carbowax PEG 3350 | Co-structuring agent | 5.0 |
| LT Blue HP | Colorant | 0.025 |
| Total | | 100 |

| Ingredient | Function | Weight % |
|---|---|---|
| Triton ® DF-16 | Non-ionic Surfactant | 25.0 |
| DI Water | | 10.0 |
| Carbowax PEG 3350 | Co-structuring agent | 65.0 |
| Total | | 100 |

Example 4: Solid Gel Hardness Measurement

Gel hardness was measured using a Tinius Olsen H5KT Force Analyzer equipped with compression plates and a 250 N load cell. Molten gel composition was cast into a circular mold (1 inch diameter×0.5 inch in thickness), opened at both ends and placed on a metal sheet. After cooling and being solidified, excess solid gel was scrapped to provide a flat surface. The solid gel was then placed into a bag and placed between the two plates. The instrument moves downward 1 inch/min until the sample was displaced by 0.25 inches. Force (in Newton, N) at yield point was recorded as a function of displacement distance. A gel that can withstand a higher force is a stronger gel. The yield strength is recorded as the highest force before the gel structure breaks, indicated by a decrease in the force.

Example 5: Measurement of Melting and Solidification Temperatures

Melting and solidification temperatures were measured using a DSC (Q2000, TA Instruments) equipped with a Refrigerated Cooling System (RCS40, TA instruments). Solid gel was weighted and sealed in a Tzero hermetic aluminum pan and heated from 25° C. to 100° C., and cooled back to 25° C. at a rate of 20° C./min to ensure uniform distribution of the sample in the pan. The sample was then exposed to two heating (from 25° C. to 100° C.) and cooling cycles (from 100° C. to 25° C.) at 10° C./min.

Example 6: Solid Gel Formulations and Properties

It is desirable to include a functional nonionic surfactant into the solid gel to aid in dish cleaning. But it has been discovered that addition of such surfactants can impact the physical properties of the solid gel. As shown below in Table 1, the solid gel hardness was increased by addition of nonionic surfactant Triton® DF-16. For example, addition of 25% Triton DF-16 in place of the DPG resulted in a hardness increase from 62.9 N to 129.4 N (comparing formulae 1 and 3). However, the response was not linear. Surprisingly, addition of 76 wt % of Triton® DF-16 resulted in a formula with lower hardness (Formula 10, hardness of 41.4 N) than the reference gel composition containing no surfactant (Formula 1, hardness 62.9 N) which does not contain any non-ionic surfactant.

TABLE 1

Effect of surfactants

| Formula | Nonionic Surfactant | Sodium Stearate % | Water % | DPG % | Hardness (Max Force) N | Solidification ° C. | M.P. ° C. |
|---|---|---|---|---|---|---|---|
| 1* | None | 5 | 19 | 76 | 62.9 | 52.1 | 71.7 |
| 3 | 25% SLF-180 | 5 | 19 | 51 | 129.4 | 49.2 | 58.0 |
| 4 | 40% SLF180 | 5 | 19 | 36 | 159.4 | 45.2 | 57.8 |
| 5 | 60% SLF180 | 5 | 19 | 16 | 94.2 | 45.4 | 58.3 |
| 6 | 76% SLF-180 | 5 | 19 | — | 61.3 | 48.2 | 58.7 |
| 7 | 25% Triton DF16 | 5 | 19 | 51 | 141.5 | 42.1 | 55.5 |
| 8 | 40% Triton DF16 | 5 | 19 | 36 | 108.4 | 41.6 | 57.1 |
| 9 | 60% Triton DF16 | 5 | 19 | 16 | 77.4 | 40.7 | 53.6 |
| 10 | 76% Triton DF16 | 5 | 19 | — | 41.4 | 39.6 | 52.5 |

*Formula 1 is a reference solid gel formulation which does not contain non-ionic surfactant.

Similarly, as shown in Table 1, the solid gel hardness was increased by addition of nonionic surfactant Plurafac® SLF-180, but the response was not linear. Addition of 40 wt % of Plurafac® SLF-180 (Formula 4) reached a maximum hardness. Addition of 76 wt % of Plurafac® SLF-180 (Formula 6) resulted in a formula with similar hardness (hardness of 61.3 N) as that of the reference solid gel composition (Formula 1, hardness 62.9 N). Solid gels with low hardness values may deform during normal manufacturing and shipping conditions. It has been discovered that solid gels containing between about 25 and about 60% alkoxylated alcohols resulted in higher solid gel hardness.

Example 7: Effect of Polar Organic Solvent on Solid Gel Hardness

Three solid gel compositions according to the present disclosure were compared to evaluate the effect of polar organic solvent on gel hardness.

TABLE 2

Effect of polar solvent on solid gel hardness

| Formula | Nonionic Surfactant | Sodium Stearate (%) | Water (%) | DPG (%) | Hardness (Max Force, N) |
|---|---|---|---|---|---|
| 1 | None | 5 | 19 | 76 | 62.9 |
| 7 | 25% Triton ® DF-16 | 5 | 19 | 51 | 141.5 |
| 11 | 25% Triton ® DF-16 | 5 | 12 | 58 | 105.2 |

As shown in in Table 2, replacing 25 wt % dipropylene glycol in the reference gel (Formula 1) with non-ionic surfactant Triton® DF-16 (Formula 7) increased gel hardness from 62.9 N to 141.5 N. Modification of Formula 7 by increasing the weight percent of dipropylene glycol (Formula 11) decreased gel hardness from 141.5 N to 105.2 N. However, the gel hardness of Formula 11 was still higher than that of the reference gel.

Example 8: Performance of the Solid Gel—Dishwashing

The solid gel compositions according to the present disclosure are tested for their cleaning performance, e.g., spotting and filming. Two grams of a gel according to the present disclosure were measured and packaged in a PVOH pouch. No other detergent was used. Water was used as control. The testing was conducted according to ASTM D 3556 (Standard Test Method for Deposition on Glassware During Mechanical Dishwashing). The testing was performed in water with a harness of 150 and 300 ppm $CaCO_3$, respectively. A standard food soil of 80 wt % margarine and 20 wt % of powdered milk were used for testing. Forty grams of food soil was distributed across 6 dinner plates. Eight glass tumblers from each dishwasher were evaluated. Five dishwasher cycles were run for each evaluation. Glass tumblers were then rated by trained technician using the rating scale in the following table:

| Rating | Spotting | Filming |
|---|---|---|
| 1 | no spots | none |
| 2 | Spots at random | barely perceptible |
| 3 | about ¼ of surface covered | slight |
| 4 | about ½ of surface covered | moderate |
| 5 | virtually completely covered | heavy |

In addition, two solid gels as described in Examples 1 and 2 were tested for their cleaning performance (spotting, filming and filming intensity mean). The results are summarized in the table below:

| | Water (control) | Gel of Example 1 | Gel of Example 2 |
|---|---|---|---|
| Spotting (150 ppm $CaCO_3$) | 2.7 | 3.0** | 2.0* |
| Filming (150 ppm $CaCO_3$) | 4.8 | 4.9 | 4.8 |
| Spotting (150 ppm $CaCO_3$) | 2.8 | 3.0 | 2.0 |
| Filming (300 ppm $CaCO_3$) | 4.6 | 4.4 | 4.1 |
| Filming Intensity Mean*** | 123.97 | 91.41* | 63.99* |

*Statistically better than water control.
**Statistically worse than water control.
***Filming Intensity Mean was measured using Digieye and Image Pro Plus.

Example 9: Solid Cleaning Composition—Dishwashing

An exemplary solid cleaning composition for unit dose dishwashing detergent composition is provided below:

| Ingredient | Weight % |
|---|---|
| Soda ash | 24.8 |
| Alcohol Alkoxylate | 1.6 |
| Sodium sulfate | 31.5 |
| Sodium citrate | 2.8 |
| Trilon M granules | 7.5 |
| Acrylic Homopolymer | 6.5 |
| Sodium silicate | 3.9 |
| Enzyme | 2.9 |
| Sodium percarbonate | 16.4 |
| Colorant | 2.0 |
| Fragrance | 0.1 |
| Total | 100 |

Example 10: Solid Cleaning Composition—Fabric Cleaning and Treatment

An exemplary solid cleaning composition for unit dose fabric cleaning and treatment composition is provided below:

| Ingredient | Weight % |
|---|---|
| Sodium Carbonate | 72.2 |
| Sodium Chloride | 9.1 |
| Anionic Surfactant | 10.0 |
| Polymer | 0.9 |
| Sodium Silicate | 3.4 |
| Water/Moisture Content | 1.8 |
| Sodium Percarbonate | 1.0 |
| Brightener | 0.1 |
| Nonionic Surfactant | 0.6 |
| Enzyme | 0.5 |
| Fragrance | 0.4 |
| Total | 100.0 |

Example 11: Unit Dose Automatic Dishwashing Detergent Composition

An exemplary unit dose automatic dishwashing composition of the present disclosure is prepared by layering a solid (powder) cleaning composition and a solid gel composition in a water-soluble single-compartment container (e.g., a pouch) made of a water-soluble polymer or film, e.g., PVOH. The powder cleaning composition and the solid gel composition formulation are in direct contact. The powder and gel may be combined at various ratios. For example, a unit dose pouch product can contain 18 grams of powder and 2 grams solid gel.

Example 12: Performance Evaluation of Unit Dose Dishwashing Compositions

Unit dose dishwashing detergent compositions of the present disclosure are tested against certain commercially available unit dose automatic dishwashing detergent compositions, to determine the ability of the compositions to remove stuck-on egg residue from metal plates. To test, aluminum alloy plates are coated with raw scrambled egg liquid, and the liquid allowed to dry on the plates. The plates are then baked in an oven for approximately 30 minutes at 350° F. The plates are then individually placed in a separate domestic automatic dishwashing machine, and each washing machine is dosed with one unit dose composition of the present disclosure, or with a commercially available product. Control machines will not receive any detergent composition. Plates are then washed in a standard wash-rinse cycle in the dishwashing machines, and the plates allowed to air-dry before being examination of residual egg soil.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents. All publications, patent applications, patents, and other references mentioned herein are incorporated by reference in their entirety. In case of conflict, the present specification, including definitions, will control. In addition, section headings, the materials, methods, and examples are illustrative only and not intended to be limiting.

What is claimed is:

1. A unit dose dishwashing detergent composition comprising:

(i) a water-soluble single-compartment container defining a single compartment;

(ii) a solid cleaning composition comprising at least one detersive surfactant; and (iii) a solid gel composition comprising (a) a non-ionic surfactant in an amount from about 25 wt % to about 40 wt %;

(b) a polar organic solvent in an amount from about 50 wt % to 60 wt %;

(c) water present in an amount between about 3 wt % and about 40 wt %; and (d) a water soluble structuring agent in an amount from 0.5 wt % to about 15 wt %, or a water soluble co-structuring agent in an amount from 0.5 wt % to about 65 wt %, or a combination thereof, wherein the wt % is based on the weight of the solid gel composition;

wherein:

the structuring agent comprises a $C_{12}$-$C_{22}$ fatty acid salt, or a mixture of $C_{12}$-$C_{22}$ fatty acid salts;

the solid cleaning composition and the solid gel composition are contained in the single compartment;

the single-compartment container is a formed, sealed pouch; and the solid cleaning composition is in direct contact with the solid gel composition.

2. The unit dose product of claim 1, wherein the weight ratio of the solid cleaning composition to the solid gel composition is from about 10:1 to 1:1.

3. The unit dose composition of claim 1, wherein the structuring agent comprises sodium stearate, sodium palmitate, sodium arachidate, sodium behenate, or a mixture of thereof; and the structuring agent is present in an amount ranging from about 3 wt % to about 7 wt %, based on the weight of the solid gel composition; and wherein the composition contains no co-structuring agent.

4. The unit dose composition of claim 1, wherein the co-structuring agent comprises a polyethylene glycol, a polyethylene-polypropylene block copolymer, a polyvinyl alcohol, a polyvinyl pyrollidone, a natural or semi-synthetic polymer, or a mixture thereof, wherein the natural or semi-synthetic polymer is selected from the group consisting of gellan gum, gelatin, casein, collagen, egg whites, guar gum, acia, tragacanth, bean gum, pectin, starch, xanthan gum, dextran, magnesium aluminum silicate (Veegum), methylcellulose, ethylcellulose, hydroxyethyl cellulose, hydroxypropyl cellulose, hydroxypropyl methylcellulose, and carboxymethyl cellulose, or a mixture thereof.

5. The unit dose composition of claim 4, wherein the co-structuring agent comprises a polyethylene glycol having a molecular weight ranging from about 1,000 to about 8,000, or from about 3000 to about 5000, or about 3350, or about 4000, or about 4600; and wherein the co-structuring agent is present in a range from about 50 wt % to about 65 wt %, based on the weight of the solid gel composition.

6. The unit dose composition of claim 1, wherein the non-ionic surfactant in the solid gel composition comprises alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof.

7. The unit dose composition of claim 6, wherein the non-ionic surfactant in the solid gel composition comprises an alkoxylated alcohol.

8. The unit dose composition of claim 1, wherein the polar organic solvent comprises a monohydric or polyhydric alcohol, a glycol, an alkylene glycol, a dialkylene glycol, a trialkylene glycol, a polyethylene glycol, or a mixture thereof.

9. The unit dose composition of claim 8, wherein the polar organic solvent comprises propylene glycol, dipropylene glycol, or a mixture thereof.

10. The unit dose composition of claim 1, wherein water is present in an amount of between about 15 wt % and about 25 wt %, based on the weight of the solid gel composition.

11. The unit dose composition of claim 1, wherein the solid gel composition has one or more of the following characteristics:

(1) the solid gel has a hardness between about 10 N and about 500 N when measured on a circular solid gel sample with dimensions of 1 inch diameter ×0.5 inch thickness, or 1 inch diameter ×0.15 inch thickness, using a force analyzer;

(2) the solid gel has a solidification temperature between about 35° C. and about 70° C. when measured by Differential Scanning Calorimetry at a cooling rate of 10° C./min, and (3) the solid gel has a melting temperature between about 50° C. and about 85° C. when measured by Differential Scanning Calorimetry at a cooling rate of 10° C./min.

12. The unit dose composition of claim 1, wherein there is little or no visible intermixing occurring at the interphase between the solid cleaning composition and the solid gel composition.

13. The unit dose composition of claim 1, wherein the solid gel composition is aerated.

14. A unit dose fabric cleaning or treatment product comprising:

(i) a water-soluble single-compartment container defining a single compartment;

(ii) a solid cleaning or booster composition comprising one or more components selected from the group consisting of a detersive surfactant, a clay, a salt, an enzyme, a chelating agent, a bleach, a bleach activator, a bleach catalyst, a silicone, a soil release polymer, an anti-redeposition polymer, a fragrance, an encapsulated fragrance, a malodor control agent, a cooling agent, a colorant, a shading dye, an optical brightener, a whitening agent, a fabric softener, and a combination thereof; and (iii) a solid gel composition comprising:

(a) water, or a polar organic solvent, or a combination thereof, (b) a water soluble structuring agent in an amount from 0.5 wt % to about 15 wt %, (c) a water soluble co-structuring agent in an amount from 0.5 wt % to about 65 wt %, and (d) a non-ionic surfactant in an amount from about 25 wt % to about 40 wt %;

wherein:

the structuring agent comprises a $C_{12}$-$C_{22}$ fatty acid salt or a mixture of $C_{12}$-$C_{22}$ fatty acid salts;

the solid cleaning composition and the solid gel composition are contained in the single compartment;

the solid cleaning composition is in direct contact with the solid gel composition;

water, if present in the composition, is in an amount between about 3 wt % and about 30 wt %, and the solid gel composition has one or more of the following characteristics:

(1) the solid gel has a hardness between about 10 N and about 500 N when measured on a circular solid gel sample with dimensions of 1 inch diameter ×0.5 inch thickness, or 1 inch diameter ×0.15 inch thickness, using a force analyzer;

(2) the solid gel has a solidification temperature between about 35° C. and about 70° C. when measured by Differential Scanning Calorimetry at a cooling rate of 10° C./min; and (3) the solid gel has a melting temperature between about 50° C. and about 85° C. when measured by Differential Scanning Calorimetry at a heating rate of 10° C./min.

15. The unit dose composition of claim 14, wherein the solid gel composition further comprising an anionic surfactant, a zwitterionic surfactant, a non-ionic surfactant, a fragrance, an encapsulated fragrance, a silicone, an anti-redeposition polymer, a grease or soil release polymer, an enzyme, a malodor control agent, a dye, a dye transfer inhibitor, or a combination thereof.

16. The unit dose product of claim 14, wherein the structuring agent comprises sodium stearate, sodium palmitate, sodium arachidate, sodium behenate, or a mixture of thereof[, and wherein the structuring agent is present in an amount ranging from about 0.5 wt % to about 15 wt %, based on the weight of the solid gel composition].

17. The unit dose composition of claim 14, wherein the co-structuring agent comprises a polyethylene glycol, a polyethylene-polypropylene block copolymer, a polyvinyl alcohol, a polyvinyl pyrollidone, a natural or semi-synthetic polymer, or a mixture thereof, wherein the natural or semi-synthetic polymer is selected from the group consisting of gellan gum, gelatin, casein, collagen, egg whites, guar gum, acai, tragacanth, bean gum, pectin, starch, xanthan gum, dextran, magnesium aluminum silicate (Veegum), methylcellulose, ethylcellulose, hydroxyethyl cellulose, hydroxypropyl cellulose, hydroxypropyl methylcellulose, and carboxymethyl cellulose, or a mixture thereof.

18. The unit dose composition of claim 17, wherein the costructuring agent comprises a polyethylene glycol having a molecular weight from about 1,000 to about 8,000[, and wherein the co-structuring agent is present in an amount from about 0.5 wt % to about 95 wt %, based on the weight of the solid gel composition].

19. The unit dose composition of claim 14, wherein the polar organic solvent comprises a monohydric or a polyhydric alcohol, a glycol, an alkylene glycol, a dialkylene glycol, a trialkylene glycol, a polyethylene glycol, or a mixture thereof, and wherein the polar organic solvent is present in an amount between about 2 wt % and about 65 wt %, based on the weight of the solid gel composition.

20. The unit dose composition claim 15, wherein the non-ionic surfactant comprises alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, or a combination thereof.

* * * * *